US009213304B2

(12) United States Patent
Shimizu et al.

(10) Patent No.: US 9,213,304 B2
(45) Date of Patent: Dec. 15, 2015

(54) CARTRIDGE PROVIDED WITH COVER MEMBER INCLUDING A PLURALITY OF COVERS SEPARABLE FROM EACH OTHER

(71) Applicant: Brother Kogyo Kabushiki Kaisha, Nagoya-shi, Aichi-ken (JP)

(72) Inventors: Keita Shimizu, Tsushima (JP); Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/315,699

(22) Filed: Jun. 26, 2014

(65) Prior Publication Data

US 2015/0003868 A1 Jan. 1, 2015

(30) Foreign Application Priority Data

Jun. 28, 2013 (JP) ..... 2013-137421

(51) Int. Cl.
*G03G 15/08* (2006.01)
*G03G 21/16* (2006.01)

(52) U.S. Cl.
CPC ..... *G03G 21/1647* (2013.01); *G03G 15/0896* (2013.01); *G03G 21/1676* (2013.01)

(58) Field of Classification Search
CPC ..... G03G 15/0896; G03G 21/1647; G03G 21/1676
USPC ..... 399/107, 111, 119
See application file for complete search history.

(56) References Cited

U.S. PATENT DOCUMENTS

| | | | | |
|---|---|---|---|---|
| 5,878,309 | A * | 3/1999 | Nomura et al. | 399/111 |
| 6,169,865 | B1 * | 1/2001 | Miyabe et al. | 399/111 |
| 6,970,668 | B2 | 11/2005 | Ueno et al. | |
| 7,162,181 | B2 * | 1/2007 | Maeshima et al. | 399/109 |
| 7,599,640 | B2 * | 10/2009 | Sato | 399/90 |
| 2002/0172528 | A1 * | 11/2002 | Sekine | 399/109 |
| 2005/0008391 | A1 | 1/2005 | Ueno et al. | |
| 2011/0236064 | A1 | 9/2011 | Fujii | |
| 2013/0170845 | A1 * | 7/2013 | Itabashi | 399/12 |

FOREIGN PATENT DOCUMENTS

| | | | |
|---|---|---|---|
| JP | 04157488 | A * | 5/1992 |
| JP | H04-156484 | A | 5/1992 |
| JP | 2004-151563 | A | 5/2004 |
| JP | 2011-203368 | A | 10/2011 |

* cited by examiner

*Primary Examiner* — Francis Gray
(74) *Attorney, Agent, or Firm* — Banner & Witcoff, Ltd.

(57) ABSTRACT

A cartridge includes: a frame; an agitator; a coupling; a first transmission gear; a closing member; and a cover member. The frame has a first wall having a developer filling port, and a second wall spaced apart from the first wall. The agitator is supported to the first and second walls. The coupling is provided at the first wall and receives a drive force from an external drive source. The first transmission gear is provided at the first wall and transmits the drive force received by the coupling to the agitator. The closing member is provided at the first wall and closes the developer filling port. The cover member is provided at the first wall. The cover member includes: a first cover to cover the first transmission gear; and a second cover provided separately from the first cover and to cover the closing member.

18 Claims, 14 Drawing Sheets

CARTRIDGE PROVIDED WITH COVER MEMBER INCLUDING A PLURALITY OF COVERS SEPARABLE FROM EACH OTHER

CROSS REFERENCE TO RELATED APPLICATION

This application claims priority from Japanese Patent Application No. 2013-137421 filed Jun. 28, 2013. The entire content of the priority application is incorporated herein by reference.

TECHNICAL FIELD

The present invention relates to a cartridge used in an electrophotographic image forming apparatus.

BACKGROUND

There is conventionally known, as an image forming apparatus, a printer in which a cartridge having a developing roller is detachably mountable.

As such a printer, there is proposed a printer including a developing device provided with a gear train for a drive system, and a side cover for protecting the gear train.

Such a printer further includes a toner replenishing member for replenishing the developing device with toner. The developing device and the toner replenishing member are detachably attached to a main casing of the printer.

SUMMARY

In such a configuration, it is considered that the gear train and a toner filling port are both disposed at one side of the developing device and collectively covered by a side cover.

The above technique allows reduction in size of the developing unit, however, when the side cover is removed for toner filling, even a member unnecessary for the toner filling, such as a gear in the drive system covered by the side cover, is exposed to an outside and may be subject to damage.

In view of the foregoing, it is an object of the present invention to provide a cartridge capable of increasing reliability.

In order to attain the above and other objects, the present invention provides a cartridge that may include: a frame; an agitator; a coupling; a first transmission gear; a closing member; and a cover member. The frame may have a first wall and a second wall spaced apart from the first wall. The first wall may have a developer filling port. The agitator may be supported to the first wall and the second wall. The coupling may be provided at the first wall and configured to receive a drive force from an external drive source. The first transmission gear may be provided at the first wall and configured to transmit the drive force received by the coupling to the agitator. The closing member may be provided at the first wall and configured to close the developer filling port. The cover member may be provided at the first wall. The cover member may include: a first cover that may be configured to cover the first transmission gear; and a second cover that may be provided separately from the first cover and configured to cover the closing member.

According to another aspect, the present invention provides a cartridge that may include: a frame; an agitator; a coupling; a first transmission gear; a closing member; and a cover member. The frame may be configured to accommodate developing agent therein. The frame may have a developer filling port. The agitator may be configured to agitate the developing agent. The coupling may be configured to receive a drive force from an external drive source. The first transmission gear may be configured to transmit the drive force received by the coupling to the agitator. The closing member may be configured to close the developer filling port. The cover member may include: a first cover that may be configured to cover the first transmission gear; and a second cover that may be provided separately from the first cover and configured to cover the closing member.

DETAILED DESCRIPTION

1. General Structure of Developing Cartridge

A developing cartridge as an example of a cartridge according to one embodiment of the present invention will be described with reference to FIG. 1.

Figure 1:
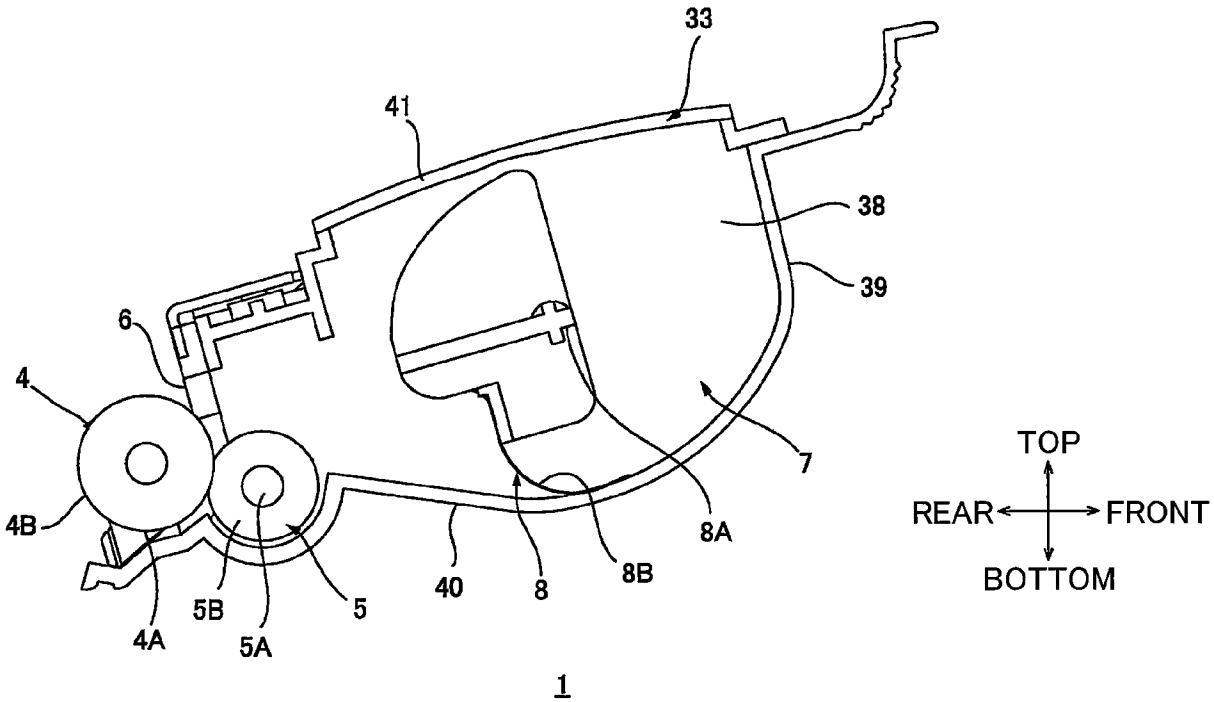
FIG. 1 is a central cross-sectional view of a developing cartridge as a cartridge according to one embodiment of the present invention.

As illustrated in FIG. 1, the developing cartridge 1 is configured to be attached to and detached from a drum cartridge 18 (described later). The developing cartridge 1 includes a developing roller 4, a supply roller 5, a layer thickness regulation blade 6, a toner chamber 7, and an agitator 8.

In the following description, the terms "upward", "downward", "upper", "lower", "above", "below", "beneath", "right", "left", "front", "rear" and the like will be used assuming that the developing cartridge 1 is disposed in such an orientation that the developing roller 4 is disposed on a rear side. More specifically, in FIG. 1, a left side and a right side are a rear side and a front side, respectively. Further, in FIG. 1, a top side and a bottom side are a top side and a bottom side, respectively. Further, left and right sides of the developing cartridge 1 will be based on the perspective of a user facing the front of the developing cartridge 1. Therefore, the near side of the developing cartridge 1 in FIG. 1 will be referred to as the "left side," and the far side thereof will be referred to as the "right side."

The developing roller 4 is disposed at a rear end portion of the developing cartridge 1. The developing roller 4 includes a developing roller shaft 4A, and a rubber roller 4B.

The developing roller shaft 4A has a substantially columnar shape extending in a left-right direction.

The rubber roller 4B covers the entire developing roller shaft 4A, excluding left and right end portions thereof.

The developing roller 4 is rotatably supported to a left wall 37 (described later) and a right wall 38 (described later) such that the left and right end portions of the developing roller shaft 4A protrude outward in the left-right direction from the left and right walls 37 and 38, respectively. The rubber roller 4B of the developing roller 4 contacts a photosensitive drum 20 (described later) from a front side thereof.

The supply roller 5 is disposed diagonally below and frontward of the developing roller 4. The supply roller 5 includes a supply roller shaft 5A, and a sponge roller 5B.

The supply roller shaft 5A has a substantially columnar shape extending in the left-right direction.

The sponge roller 5B covers the entire supply roller shaft 5A, excluding left and right end portions thereof.

The supply roller 5 is rotatably supported to the left wall 37 (described later) and the right wall 38 (described later) such that the left and right end portions of the supply roller shaft 5A protrude outward in the left-right direction from the left and right walls 37 and 38, respectively. The sponge roller 5B of the supply roller 5 contacts the developing roller 4 from a lower-front side thereof.

The layer thickness regulation blade 6 is disposed diagonally above and frontward of the developing roller 4. The layer thickness regulation blade 6 contacts the developing roller 4 from a front side thereof.

The developing cartridge 1 defines an internal space serving as a toner chamber 7. The toner chamber 7 is positioned frontward of the supply roller 5 and the layer thickness regulation blade 6. The toner chamber 7 is adapted to accommodate toner therein. The agitator 8 is disposed in the toner chamber 7.

The agitator 8 includes an agitator shaft 8A, and an agitating blade 8B.

The agitator shaft 8A has a substantially columnar shape extending in the left-right direction.

The agitating blade 8B is formed of a film having flexibility. The agitating blade 8B extends outward in a radial direction of the agitator shaft 8A from a left-right center portion of the agitator shaft 8A, that is, a portion excluding left and right end portions of the agitator shaft 8A.

The agitator 8 is rotatably supported to the left wall 37 (described later) and the right wall 38 (described later) such that the left and right end portions of the agitator shaft 8A protrude outward in the left-right direction from the left and right walls 37 and 38, respectively.

2. Overall Structure of Printer

Figure 2:
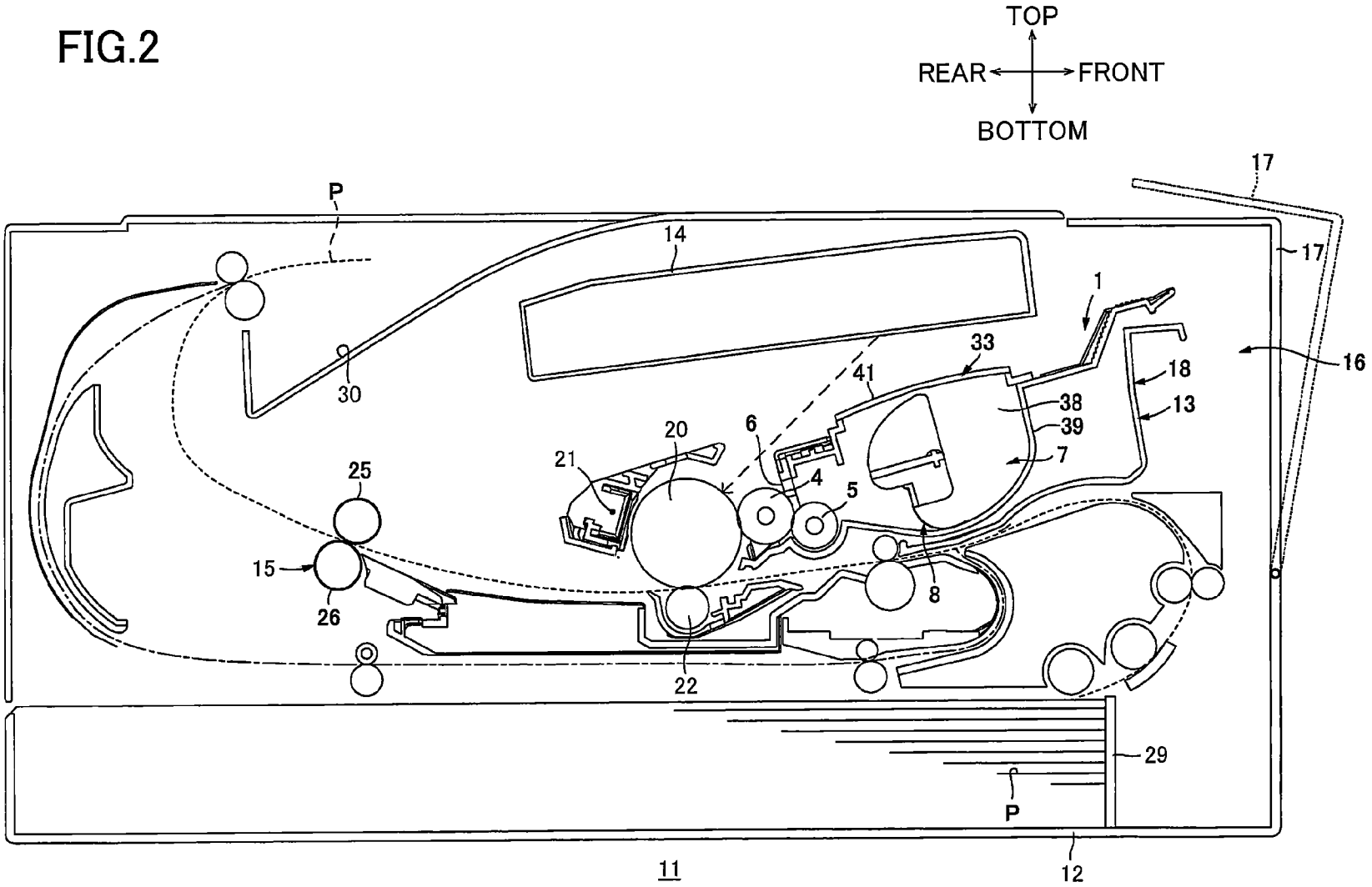
FIG. 2 is a central cross-sectional view of a printer for which the developing cartridge in FIG. 1 is used.

As illustrated in FIG. 2, a printer 11 to which the developing cartridge 1 is detachably mountable is an electrophotographic monochromatic printer. The printer 11 includes a main casing 12, a process cartridge 13, a scanner unit 14, and a fixing unit 15.

The main casing 12 has a substantially box-like shape. The main casing 12 has a front wall formed with an opening portion 16. The main casing 12 includes a front cover 17, a sheet cassette 29, and a discharge tray 30.

The opening portion 16 penetrates the front wall of the main casing 12 in a front-rear direction so as to allow the process cartridge 13 to pass therethrough.

The front cover 17 has a substantially plate-like shape. The front cover 17 is supported to the front wall of the main casing 12 and pivotally movable about its lower end portion. The front cover 17 opens and closes the opening portion 16.

The sheet cassette 29 is disposed at a bottom portion of the main casing 12. The sheet cassette 29 is adapted to accommodate sheets of paper P.

The discharge tray 30 is disposed at a top surface of the main casing 12.

The process cartridge 13 is configured to be attached to and detached from the main casing 12. The process cartridge 13 includes the developing cartridge 1 and the drum cartridge 18.

The drum cartridge 18 includes the photosensitive drum 20, a scorotron charger 21, and a transfer roller 22.

The photosensitive drum 20 is rotatably supported at a rear end portion of the process cartridge 13. The photosensitive drum 20 has a substantially cylindrical shape elongated in the left-right direction.

The scorotron charger 21 is disposed rearward of the photosensitive drum 20 and spaced apart from the photosensitive drum 20.

The transfer roller 22 is disposed below the photosensitive drum 20. The transfer roller 22 contacts the photosensitive drum 20 from a lower side thereof.

The scanner unit 14 is disposed above the process cartridge 13. As denoted by a dashed line of FIG. 2, the scanner unit 14 is adapted to emit a laser beam based on image data toward the photosensitive drum 20.

The fixing unit 15 is disposed rearward of the process cartridge 13. The fixing unit 15 includes a heating roller 25, and a pressure roller 26 in pressure contact with the heating roller 25 from a lower-rear side thereof.

When the printer 11 performs an image forming operation, the scorotron charger 21 applies a uniform charge to a surface of the photosensitive drum 20. Thereafter, the scanner unit 14 exposes the surface of the photosensitive drum 20. As a result, an electrostatic latent image based on image data is formed on the surface of the photosensitive drum 20.

The agitator 8 agitates the toner accommodated in the toner chamber 7 and supplies the agitated toner to the supply roller 5. The supply roller 5 supplies the toner supplied from the agitator 8 to the developing roller 4. At this time, the toner is positively tribo-charged between the developing roller 4 and the supply roller 5 to be carried on the developing roller 4. The layer thickness regulation blade 6 regulates the toner carried on the developing roller 4 so that the developing roller 4 carries on its surface a thin layer of toner having a uniform thickness.

The toner carried on the developing roller 4 is supplied to the electrostatic latent image formed on the surface of the photosensitive drum 20. As a result, a toner image is carried on the surface of the photosensitive drum 20.

In the meantime, various rollers convey the sheets of paper P from the sheet cassette 29 at a prescribed timing, and supply the sheets P one at a time to a position between the photosensitive drum 20 and the transfer roller 22. The toner image on the photosensitive drum 20 is transferred onto the sheet P upon passage to the position between the photosensitive drum 20 and the transfer roller 22.

The sheet P onto which the toner image has been transferred passes between the heating roller 25 and the pressure roller 26, at which time the heating roller 25 applies heat to the sheet P while the pressure roller 26 applies pressure to the sheet P, thermally fixing the toner image to the sheet P. Thereafter, the sheet P is discharged onto the discharge tray 30.

3. Detailed Description of Developing Cartridge

The structure of the developing cartridge 1 according to the embodiment of the present invention will be described in greater detail with reference to FIGS. 3 through 13B, wherein like parts and components are designated by the same reference numerals to avoid duplicating description.

Figure 3:
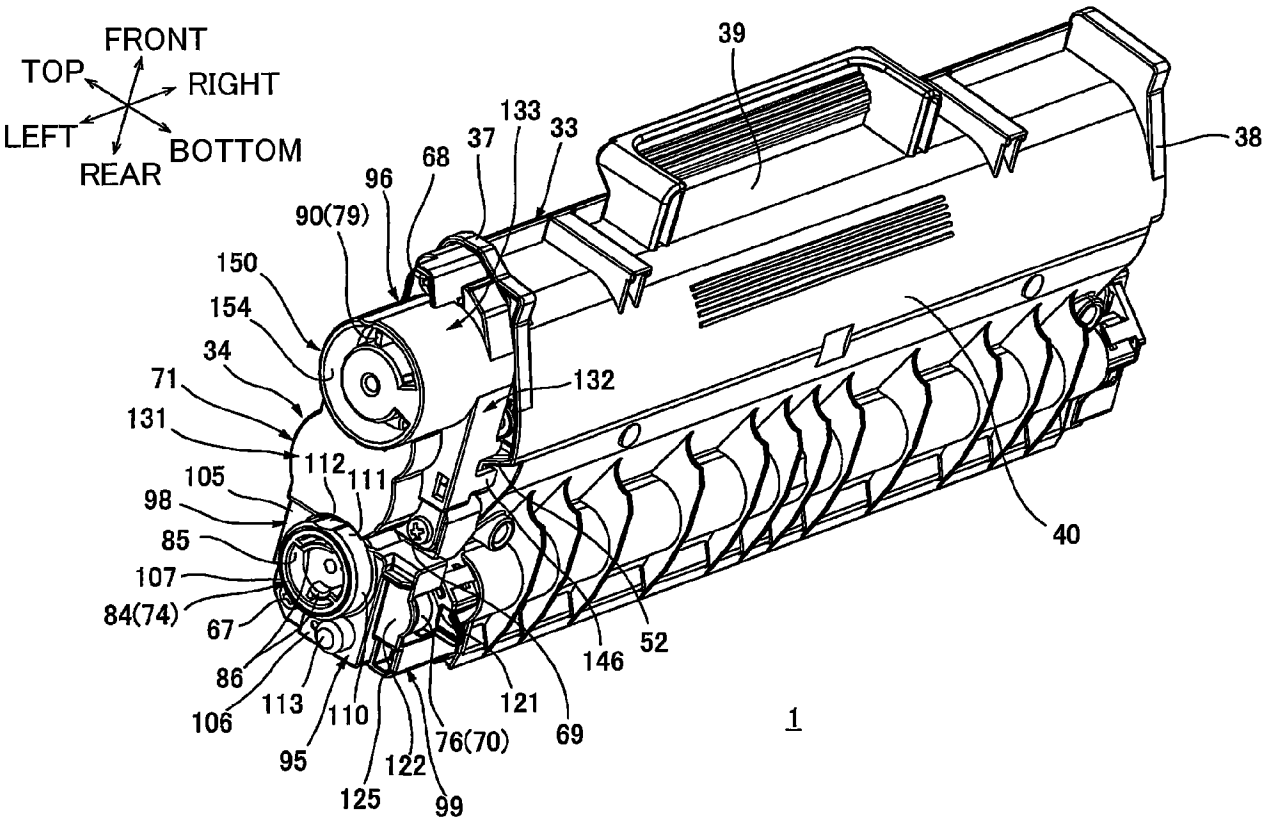
FIG. 3 is a perspective view of the developing cartridge in FIG. 1 as viewed from a lower-left side thereof.
Figure 4:
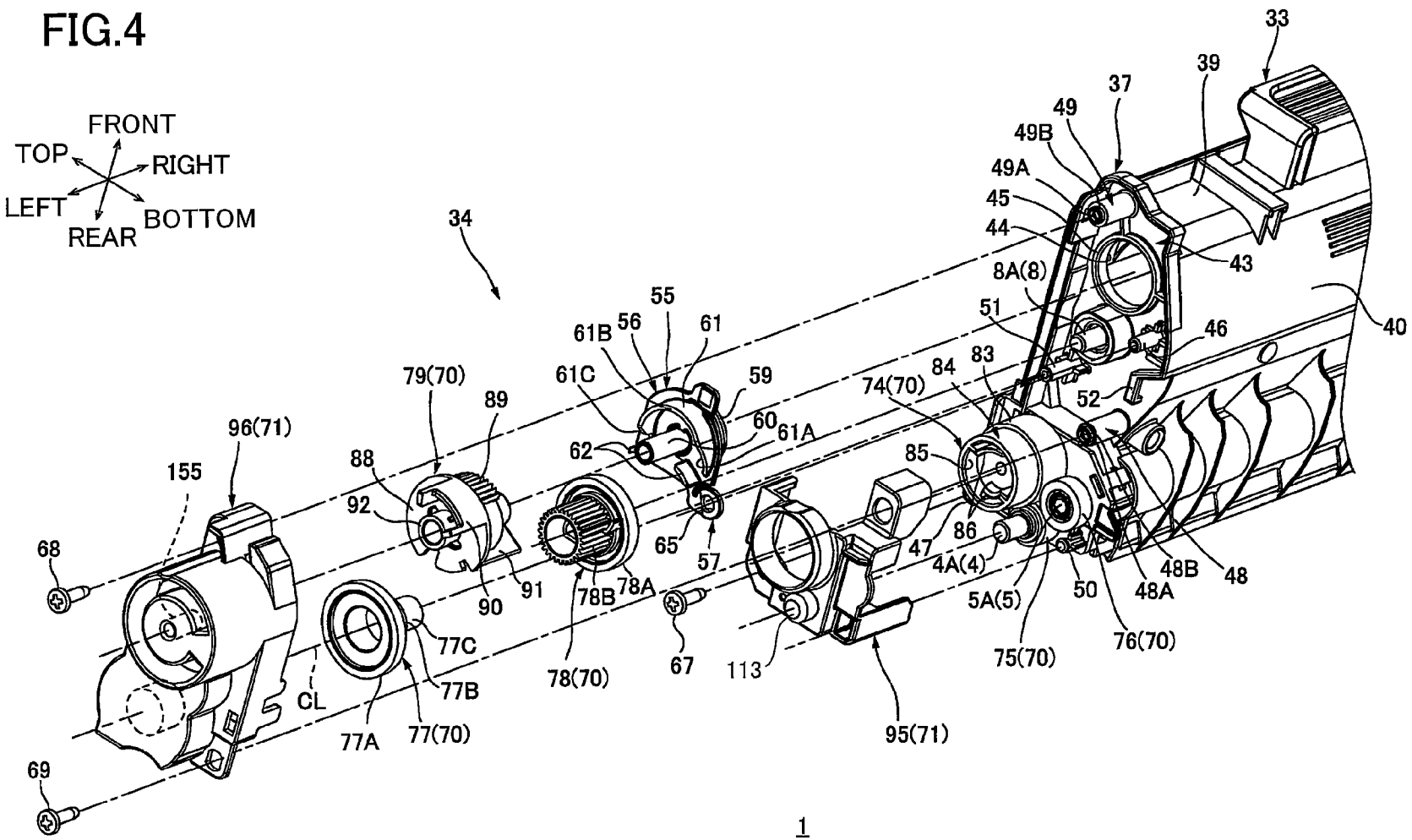
FIG. 4 is an exploded partial perspective view of the developing cartridge in FIG. 1 as viewed from a lower-left side thereof, from which a gear train and a gear cover has been removed.

As illustrated in FIGS. 3 and 4, the developing cartridge 1 includes a frame 33, and a drive unit 34.

(1) Frame

The frame 33 is formed of a resin such as polystyrene (PS). The frame 33 has a substantially box-like shape elongated in the left-right direction. More specifically, the frame 33 includes the left wall 37 as an example of a first wall, the right wall 38 as an example of a second wall, a front wall 39, a bottom wall 40, and a top wall 41 (see FIG. 6).

As illustrated in FIG. 4, the left wall 37 is disposed at a left end portion of the frame 33. The left wall 37 has a plate-like shape that is substantially rectangular in a side view and elongated in the front-rear direction. The left wall 37 includes a toner filling portion 43, a cap 55 as an example of a closing member, a first screwed portion 47, a co-fastening screwed portion 48, a second screwed portion 49, a protruding portion 50, an idle gear support shaft 51, and a hooking portion 52.

The toner filling portion 43 is disposed at a front end portion of the left wall 37. The toner filling portion 43 includes a toner filling port 44, a toner filling cylindrical portion 45, and a cap positioning portion 46.

The toner filling port 44 has a substantially circular shape in a side view, and penetrates the left wall 37 in the left-right direction.

The toner filling cylindrical portion 45 has a substantially hollow cylindrical shape. The toner filling cylindrical portion 45 extends leftward from a left surface of the left wall 37 at a peripheral edge defining the toner filling port 44. The toner filling cylindrical portion 45 has an inner diameter substantially the same as an inner diameter of the toner filling port 44.

The cap positioning portion 46 is disposed diagonally below and rearward of the toner filling port 44. The cap positioning portion 46 has a substantially columnar shape protruding leftward from the left surface of the left wall 37.

The cap 55 includes a closing portion 56 and a reed-like piece 57.

The closing portion 56 is configured to close the toner filling port 44. The closing portion 56 has a plate-like shape that is substantially circular in a side view. The closing portion 56 includes a cap cylindrical portion 59, a detection gear support shaft 60, a guide portion 61, and a pair of stoppers 62.

The cap cylindrical portion 59 has a substantially cylindrical shape extending rightward from a right surface of the closing portion 56 at a peripheral portion thereof. The cap cylindrical portion 59 has an outer diameter slightly smaller than the inner diameter of the toner filling port 44.

The detection gear support shaft 60 has a substantially columnar shape extending leftward from a left surface of the closing portion 56 at a center portion thereof.

The guide portion 61 protrudes leftward from a left surface of the closing portion 56 at a front half of a peripheral portion thereof. The guide portion 61 has a substantially semi-circular arc shape centering on the detection gear support shaft 60 in a left side view. The guide portion 61 has a left end surface that is gradually inclined leftward from its upstream end in a counterclockwise direction in a left side view toward its intermediate portion in the counterclockwise direction in a left side view, extends parallel to the closing portion 56 at the intermediate portion, and is then gradually inclined rightward toward its downstream end in the counterclockwise direction in a left side view.

In the left side surface of the guide portion 61, the upstream end in the counterclockwise direction in a left side view will be referred to as an upstream inclined portion 61A, the intermediate portion in the counterclockwise direction in a left side view will be referred to as an intermediate flat portion 61B, and the downstream end in the counterclockwise direction in a left side view will be referred to as a downstream inclined portion 61C.

The pair of stoppers 62 is disposed respectively at upstream and downstream ends of the guide portion 61 in the counterclockwise direction in a left side view so as to be spaced apart therefrom. That is, the pair of stoppers 62 is disposed rearward of the upstream inclined portion 61A and the downstream inclined portion 61C, respectively, so as to be spaced apart therefrom.

The reed-like piece 57 continues from a lower-rear end portion of an outer peripheral surface of the closing portion 56 and protrudes therefrom diagonally below and rearward. The reed-like piece 57 has a plate-like shape that is substantially circular in a side view. The reed-like piece 57 has a positioning hole 65.

The positioning hole 65 has a substantially circular shape in a side view and penetrates, in the left-right direction, a substantial up-down and front-rear center of the reed-like piece 57. The positioning hole 65 has an inner diameter slightly larger than an outer diameter of the cap positioning portion 46.

The cap cylindrical portion 59 of the closing portion 56 is inserted along an inner peripheral surface of the toner filling cylindrical portion 45, and the cap positioning portion 46 of the left wall 37 is inserted into the positioning hole 65 of the reed-like piece 57, whereby the cap 55 is assembled to the left wall 37 to close the toner filling port 44.

Figure 6:
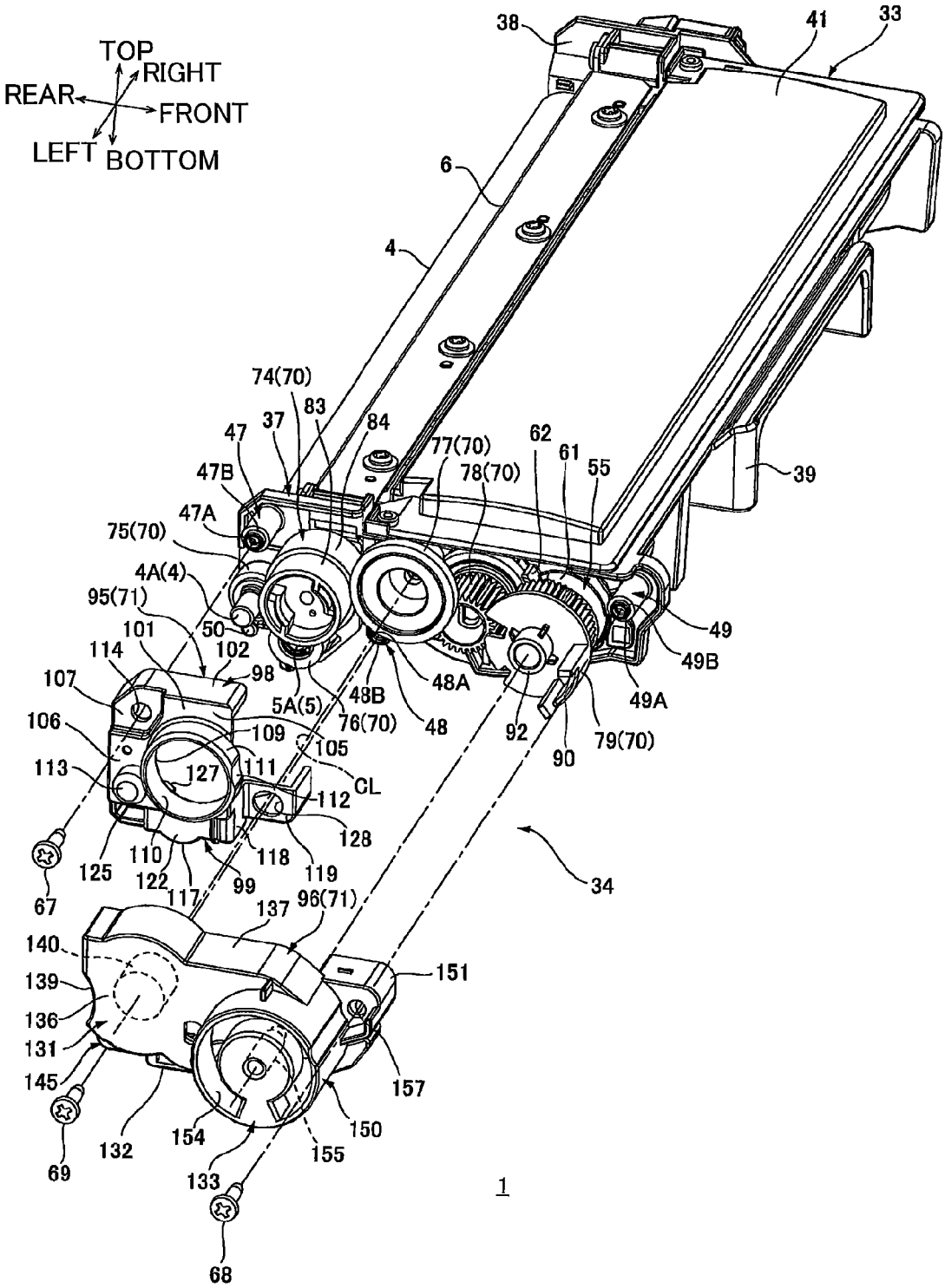
FIG. 6 is an exploded perspective view of the developing cartridge in FIG. 1 as viewed from an upper-left side thereof, to which the gear train has been assembled and from which the gear cover has been removed.

As illustrated in FIG. 6, the first screwed portion 47 is disposed at an upper-rear end portion of the left wall 37. The first screwed portion 47 has a substantially columnar shape protruding leftward from the left surface of the left wall 37. The first screwed portion 47 has a first screw hole 47A and includes a first engagement portion 47B.

The first screw hole 47A has a substantially circular shape in a side view and is recessed rightward from a left end face of the first screwed portion 47.

The first engagement portion 47B is disposed at a left end portion of the first screwed portion 47. The first engagement portion 47B has a substantially cylindrical shape extending leftward from a peripheral edge defining the first screw hole 47A.

As illustrated in FIG. 4, the co-fastening screwed portion 48 is disposed at a lower end portion of a substantial front-rear center of the left wall 37. The co-fastening screwed portion 48 has a substantially columnar shape protruding leftward from the left surface of the left wall 37. The co-fastening screwed portion 48 has a co-fastening screw hole 48A and includes a co-fastening engagement portion 48B.

The co-fastening screw hole 48A has a substantially circular shape in a side view and is recessed rightward from a left end face of the co-fastening screwed portion 48.

The co-fastening engagement portion 48B is disposed at a left end portion of the co-fastening screwed portion 48. The co-fastening engagement portion 48B has a substantially cylindrical shape extending leftward from a peripheral portion defining the co-fastening screw hole 48A.

The second screwed portion 49 is disposed at an upper-front end portion of the left wall 37. The second screwed portion 49 has a substantially columnar shape protruding leftward from the left surface of the left wall 37. The second screwed portion 49 has a second screw hole 49A and includes a second engagement portion 49B.

The second screw hole 49A has a substantially circular shape in a side view and is recessed rightward from a left end face of the second screwed portion 49.

The second engagement portion 49B is disposed at a left end portion of the second screwed portion 49. The second engagement portion 49B has a substantially cylindrical shape extending leftward from a peripheral portion defining the second screw hole 49A.

As illustrated in FIGS. 4 and 6, the protruding portion 50 is disposed at a lower-rear end portion of the left wall 37. The protruding portion 50 has a substantially columnar shape protruding leftward from the left surface of the left wall 37.

As illustrated in FIG. 4, the idle gear support shaft 51 is disposed at an upper end portion of the substantial front-rear center of the left wall 37. The idle gear support shaft 51 has a substantially columnar shape protruding leftward from the left surface of the left wall 37.

The hooking portion 52 is disposed on the left wall 37 at a position between the cap positioning portion 46 and the co-fastening screwed portion 48 in the front-rear direction. The hooking portion 52 has a plate-like shape that is substantially U-like shaped in a bottom view.

As illustrated in FIG. 3, the right wall 38 is disposed at a right end portion of the frame 33. Like the left wall 37, the right wall 38 has a plate-like shape that is substantially rectangular in a side view and elongated in the front-rear direction.

The front wall 39 is bridged between a front end portion of the left wall 37 and a front end portion of the right wall 38. The front wall 39 has a substantially plate-like shape extending in an up-down direction.

The bottom wall 40 is bridged between a lower end portion of the left wall 37 and a lower end portion of the right wall 38. The bottom wall 40 extends rearward from a lower end portion of the front wall 39 while being curved. The bottom wall 40 has a substantially plate-like shape.

As illustrated in FIG. 6, the top wall 41 is disposed on an upper end portion of the left wall 37, an upper end portion of the right wall 38, and an upper end portion of the front wall 39. The top wall 41 has a substantially plate-like shape extending in the left-right direction. The top wall 41 has a peripheral portion fixed to the upper end portion of the left wall 37, the upper end portion of the right wall 38, and the upper end portion of the front wall 39 by welding or the like.

(2) Drive Unit

Figure 5:
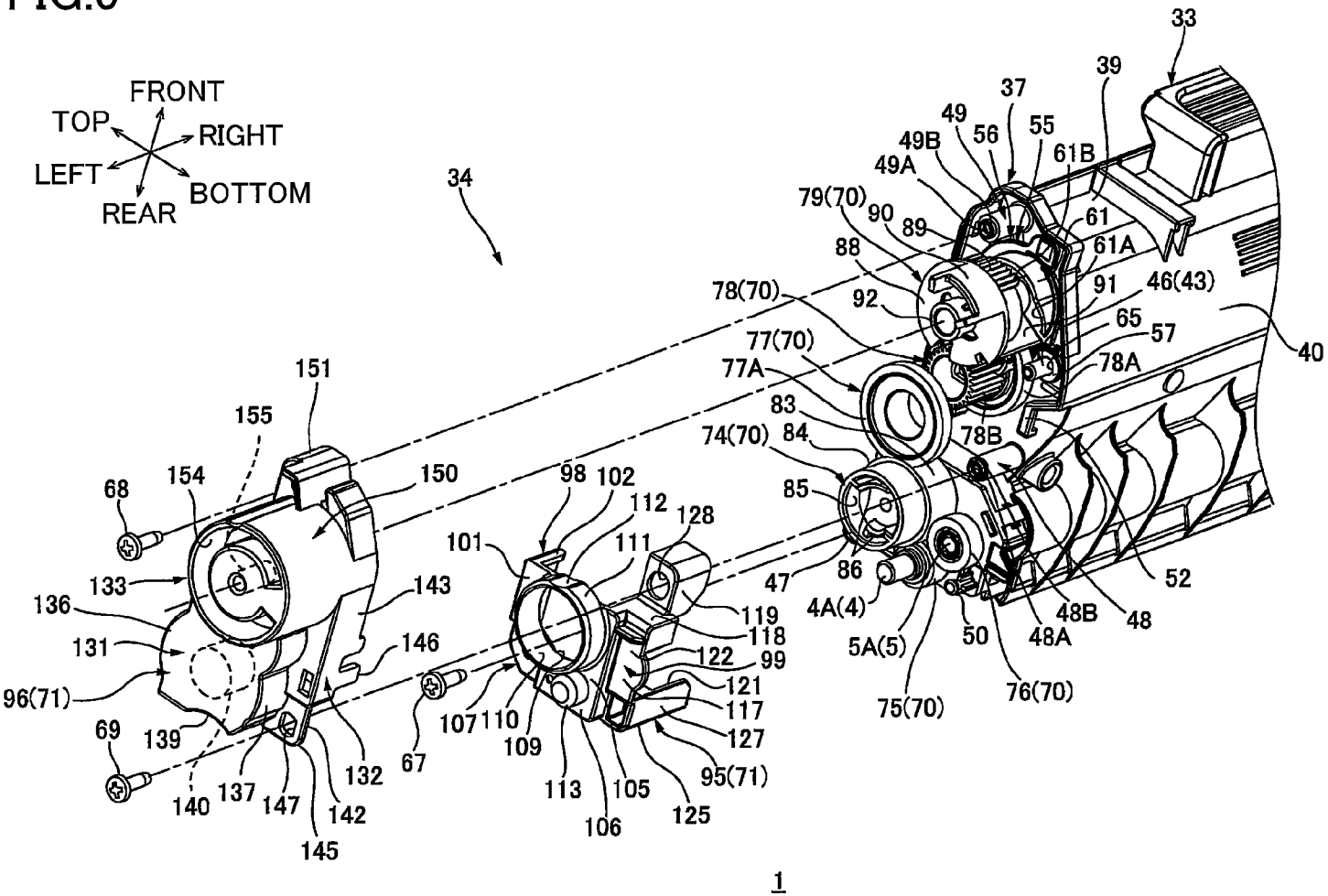
FIG. 5 is an exploded partial perspective view of the developing cartridge in FIG. 1 as viewed from a lower-left side thereof, to which the gear train has been assembled and from which the gear cover has been removed.

As illustrated in FIGS. 4 and 5, the drive unit 34 includes a gear train 70 and a gear cover 71 as an example of a cover member.

(2-1) Gear Train

The gear train 70 is provided at the left wall 37. The gear train 70 includes a developing coupling 74, a developing gear 75 as an example of a developing roller drive gear, a supply gear 76 as an example of a supply roller drive gear, an idle gear 77 as an example of a second transmission gear, an agitator gear 78 as an example of an agitator drive gear, and a detection gear 79 as an example of a gear and as an example of a rotation body.

(2-1-1) Developing Coupling

The developing coupling 74 is rotatably supported at an upper-rear end portion of the left wall 37. The developing coupling 74 has a substantially columnar shape extending in the left-right direction. The developing coupling 74 integrally includes a coupling gear portion 83 as an example of a first transmission gear and a coupling portion 84 as an example of a coupling.

The coupling gear portion 83 is disposed at a right end portion of the developing coupling 74. The coupling gear portion 83 has a substantially disk-like shape having a thickness in the left-right direction. The coupling gear portion 83 has gear teeth formed on an entire outer peripheral surface thereof.

The coupling portion 84 has a substantially columnar shape protruding leftward from a left surface of the coupling gear portion 83. The coupling portion 84 has an outer diameter smaller than an outer diameter of the coupling gear portion 83. Further, the coupling portion 84 has a center axis aligned with a center axis of the coupling gear portion 83. The coupling portion 84 includes a recessed portion 85 and a pair of projecting portions 86.

The recessed portion 85 has a substantially circular shape in a side view. The recessed portion 85 is recessed rightward from a left end face of the coupling portion 84.

The pair of projecting portions 86 each protrudes inward in a radial direction of the recessed portion 85 from an inner peripheral surface thereof in the radial direction. The pair of projecting portions 86 is disposed so as to face each other in the radial direction of the recessed portion 85. The pair of projecting portions 86 each has a substantially rectangular columnar shape extending in the left-right direction.

(2-1-2) Developing Gear

The developing gear 75 is disposed diagonally below and rearward of the developing coupling 74. The developing gear 75 has a substantially cylindrical shape extending in the left-right direction. The developing gear 75 has gear teeth formed on an entire outer peripheral surface thereof. The developing gear 75 is supported at a left end portion of the developing roller shaft 4A so as not to be rotatable relative to the developing roller shaft 4A. That is, the developing gear 75 is fixed to the developing roller shaft 4A. The developing gear 75 is meshingly engaged with a lower-rear end portion of the coupling gear portion 83 of the developing coupling 74.

(2-1-3) Supply Gear

The supply gear 76 is disposed below the developing coupling 74. The supply gear 76 has a substantially columnar shape extending in the left-right direction. The supply gear 76 has gear teeth formed on an entire outer peripheral surface thereof. The supply gear 76 is supported at a left end portion of the supply roller shaft 5A so as not to be rotatable relative to the supply roller shaft 5A. That is, the supply gear 76 is fixed to the supply roller shaft 5A. The supply gear 76 is meshingly engaged with a lower end portion of the coupling gear portion 83 of the developing coupling 74.

(2-1-4) Idle Gear

Figure 12A:
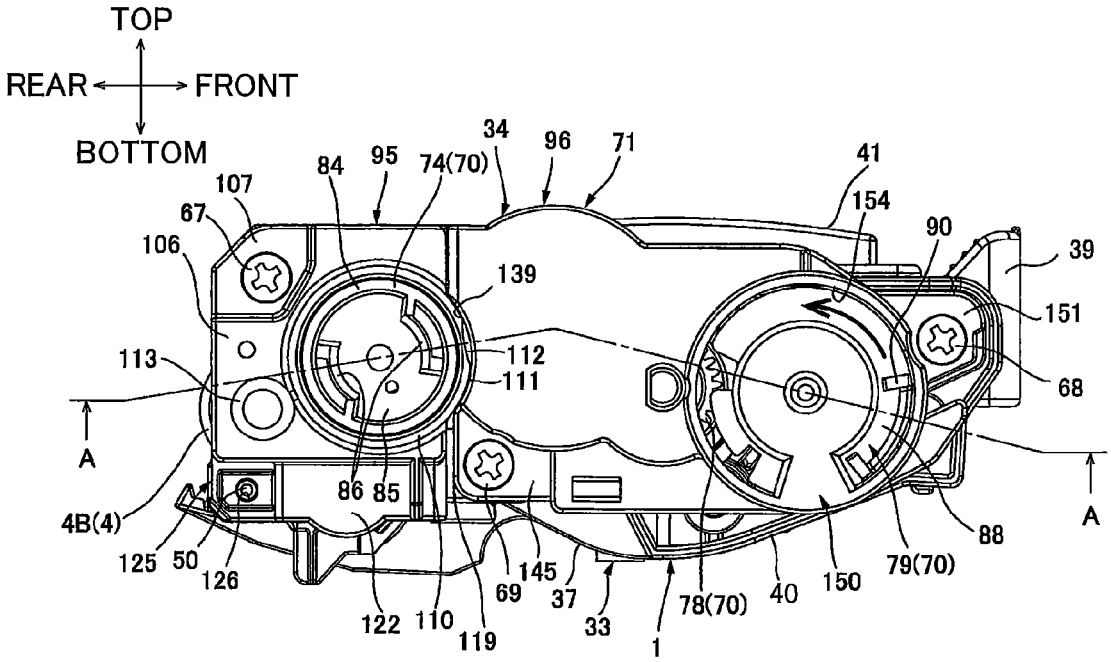
FIG. 12A is a left side view of the developing cartridge in FIG. 1 to which the first cover and the second cover have been assembled.
Figure 12B:
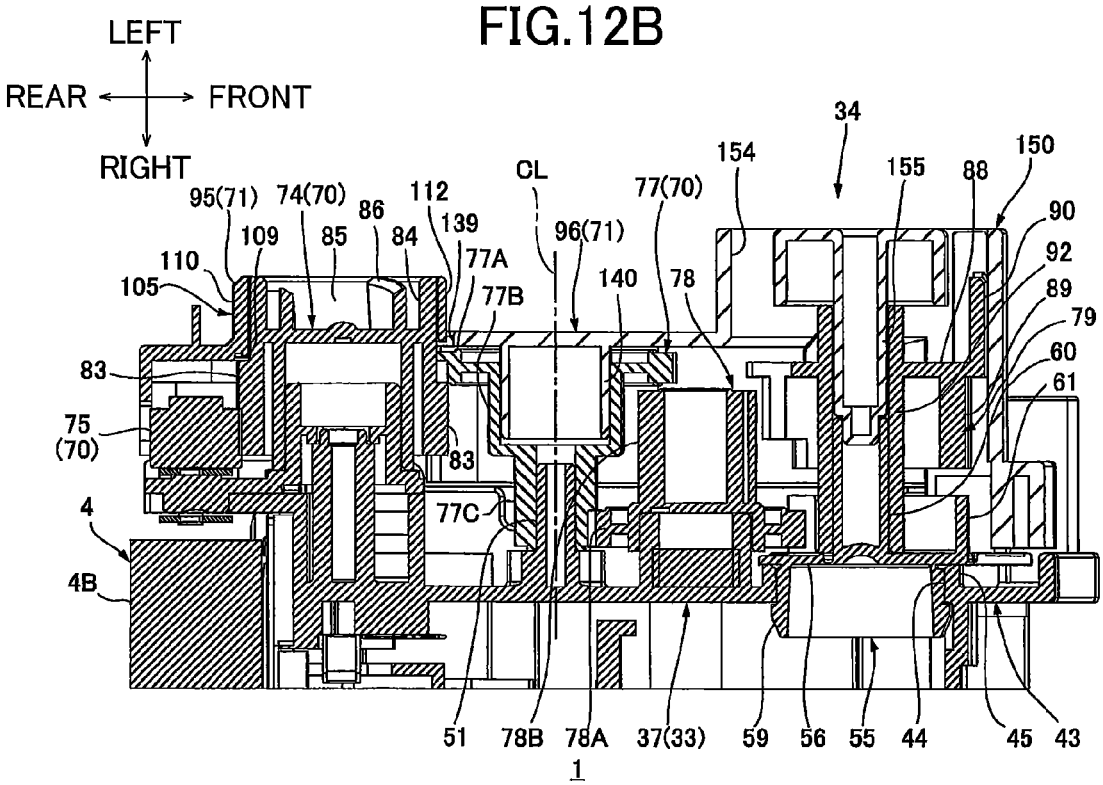
FIG. 12B is a cross-sectional view of the developing cartridge taken along a line A-A in FIG. 12A.

As illustrated in FIGS. 4 and 12B, the idle gear 77 integrally includes a large-diameter idle gear 77A, an intermediate-diameter idle gear 77B, and a small-diameter idle gear 77C.

The large-diameter idle gear 77A has a substantially annular shape having a thickness in the left-right direction. The large-diameter idle gear 77A has gear teeth formed on an entire outer peripheral surface thereof.

The intermediate-diameter idle gear 77B protrudes rightward from a right surface of the large-diameter idle gear 77A. The intermediate-diameter idle gear 77B has a substantially hollow cylindrical shape with a closed right end. The intermediate-diameter idle gear 77B has an outer diameter smaller than an outer diameter of the large-diameter idle gear 77A. The intermediate-diameter idle gear 77B has an inner diameter substantially the same as an inner diameter of the large-diameter idle gear 77A.

The small-diameter idle gear 77C has a substantially hollow cylindrical shape extending rightward from a right surface of the intermediate-diameter idle gear 77B. The small-diameter idle gear 77C has an outer diameter smaller than the outer diameter of the intermediate-diameter idle gear 77B. The small-diameter idle gear 77C has an inner diameter slightly larger than an outer diameter of the idle gear support shaft 51 protruding from the left wall 37. The small-diameter idle gear 77C has gear teeth formed on an entire outer peripheral surface thereof.

In the idle gear 77, a center axis of the large-diameter idle gear 77A, a center axis of the intermediate-diameter idle gear 77B, and a center axis of the small-diameter idle gear 77C are aligned with each other. The center axis of the idle gear 77 will be referred to a rotation axis CL.

The idle gear 77 is rotatably supported at the left wall 37 with the small-diameter idle gear 77C inserted into the idle gear support shaft 51. As a result, the idle gear 7 is disposed frontward of the developing coupling 74. The large-diameter idle gear 77A of the idle gear 77 is meshingly engaged with a front end portion of the coupling gear portion 83 of the developing coupling 74.

(2-1-5) Agitator Gear

As illustrated in FIGS. 4 and 5, the agitator gear 78 integrally includes a large-diameter agitator gear 78A and a small-diameter agitator gear 78B.

The large-diameter agitator gear 78A has a substantially annular shape having a thickness in the left-right direction. The large-diameter agitator gear 78A has gear teeth formed on an entire outer peripheral surface thereof.

The small-diameter agitator gear 78B has a substantially hollow cylindrical shape protruding leftward from a left surface of the large-diameter agitator gear 78A. The small-diameter agitator gear 78B has an outer diameter smaller than an outer diameter of the large-diameter agitator gear 78A. The small-diameter agitator gear 78B has an inner diameter substantially the same as an inner diameter of the large-diameter agitator gear 78A. The small-diameter agitator gear 78B has gear teeth formed on an entire outer peripheral surface thereof.

Figure 8:
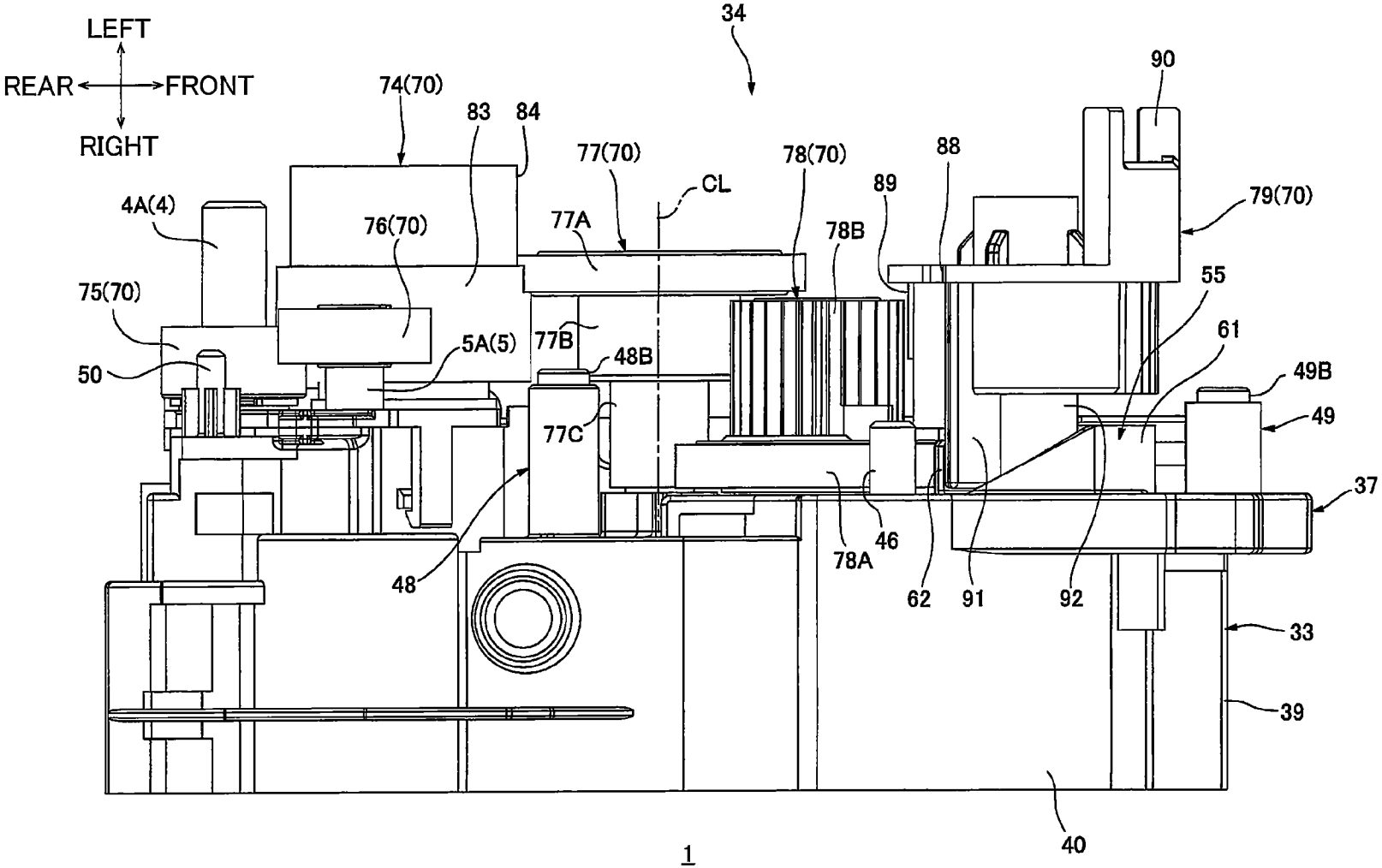
FIG. 8 is an explanatory view for illustrating the position of the gear train in FIG. 5.

The agitator gear 78 is supported at a left end portion of the agitator shaft 8A so as not to be rotatable relative to the agitator shaft 8A. That is, the agitator gear 78 is fixed to the agitator shaft 8A. As a result, the agitator gear 78 is disposed diagonally below and frontward of the idle gear 77. As illustrated in FIG. 8, the large-diameter agitator gear 78A of the agitator gear 78 is meshingly engaged with a lower-front end portion of the small-diameter idle gear 77C of the idle gear 77.

(2-1-6) Detection Gear

As illustrated in FIGS. 4 and 5, the detection gear 79 includes a detection gear base plate 88, a detection gear insertion portion 92, a detection gear portion 89, an abutting portion 90, and a slide portion 91.

The detection gear base plate 88 has a plate-like shape that is substantially circular in a side view.

The detection gear portion 89 has a substantially hollow cylindrical shape protruding rightward from a right surface of the detection gear base plate 88. The detection gear portion 89 has gear teeth formed on a half portion of an outer peripheral surface thereof. That is, the detection gear portion 89 is a chipped gear (i.e. gear teeth are partially lacking).

The detection gear insertion portion 92 has a substantially hollow cylindrical shape extending in the left-right direction and having a center axis aligned with a center axis of the detection gear portion 89. The detection gear insertion portion 92 penetrates the detection gear base plate 88 in the left-right direction. The detection gear insertion portion 92 has an inner diameter slightly larger than an outer diameter of the detection gear support shaft 60.

The abutting portion 90 is disposed outward of the detection gear insertion portion 92 in a radial direction of the detection gear portion 89. The abutting portion 90 protrudes leftward from a left surface of the detection gear base plate 88 and extends in a peripheral direction of the detection gear portion 89. The abutting portion 90 has a substantially curved plate-like shape.

The slide portion 91 protrudes rightward from a right surface of the detection gear base plate 88 and extends in a radial direction of the detection gear base plate 88. The slide portion 91 has a substantially plate-like shape.

The detection gear 79 is rotatably supported to the cap 55 with the detection gear support shaft 60 of the cap 55 inserted into the detection gear insertion portion 92. That is, the detection gear 79 is supported at the left wall 37 through the cap 55. As a result, the detection gear 79 is disposed frontward of the agitator gear 78. The detection gear portion 89 of the detection gear 79 is adapted to meshingly engage the small-diameter agitator gear 78B of the agitator gear 78.

(2-2) Gear Cover

The gear cover 71 is assembled to the left wall 37 so as to cover the gear train 70 in its entirety. The gear cover 71 includes a first cover 95 and a second cover 96.

(2-2-1) First Cover

As illustrated in FIGS. 5 and 6, the first cover 95 integrally includes a first portion 98 and a second portion 99.

The first portion 98 constitutes an upper portion of the first cover 95. The first portion 98 integrally includes a first base plate 101, and a first peripheral wall 102 protruding rightward from a peripheral edge of the first base plate 101. That is, the first portion 98 has a substantially box-like shape whose right end is opened and whose left end is closed.

The first portion 98 includes a coupling cover portion 105, a developing roller cover portion 106, and a first fixed portion 107.

The coupling cover portion 105 is provided at a substantial up-down and front-rear center of the first base plate 101. The coupling cover portion 105 has a drive input opening 109 and includes a cylindrical portion 110 as an example of a receiving portion.

The drive input opening 109 has a substantially circular shape in a side view. The drive input opening 109 penetrates the first base plate 101 in the left-right direction.

The cylindrical portion 110 has a substantially hollow cylindrical shape and extends leftward from a left surface of the first base plate 101 at a peripheral edge defining the drive input opening 109. The cylindrical portion 110 has an inner diameter substantially the same as a diameter of the drive input opening 109. Further, as illustrated in FIG. 12B, the cylindrical portion 110 has a left-right length substantially the same as a left-right length of the coupling portion 84 of the developing coupling 74.

As illustrated in FIGS. 5 and 6, a front end portion of the cylindrical portion 110 has a concave portion 112 extending in the left-right direction. Further, a peripheral surface of the cylindrical portion 110 has a first guide surface 111 at its front end.

The developing roller cover portion 106 is provided at a rear end portion of a substantial up-down center of the first base plate 101. The developing roller cover portion 106 is disposed rearward of the coupling cover portion 105. The developing roller cover portion 106 includes a collar portion 113.

The collar portion 113 has a substantially hollow cylindrical shape with a closed left end and extends in the left-right direction. The collar portion 113 has an inner diameter slightly larger than an outer diameter of the developing roller shaft 4A.

The first fixed portion 107 is provided at an upper-rear end portion of the first base plate 101. The first fixed portion 107 is disposed above the developing roller cover portion 106. The first fixed portion 107 is slightly recessed rightward from the developing roller cover portion 106. The first fixed portion 107 has a first insertion hole 114.

The first insertion hole 114 has a substantially circular shape in a side view. The first insertion hole 114 penetrates the first base plate 101 in the left-right direction. The first insertion hole 114 has an inner diameter slightly larger than an outer diameter of the first engagement portion 47B.

The second portion 99 constitutes a lower portion of the first cover 95. The second portion 99 is disposed below the first portion 98 with a stepped portion interposed therebetween. The second portion 99 integrally includes a second base plate 117 and a second peripheral wall 118 protruding rightward from a peripheral edge of the second base plate 117. That is, the second portion 99 has a substantially box-like shape whose right end is opened and whose left end is closed.

The second portion 99 includes a supply roller cover portion 122, an engaging portion 125, a cutout portion 121, and a first co-fastening portion 119.

The supply roller cover portion 122 is provided at a substantial front-rear center of the second base plate 117. The supply roller cover portion 122 is disposed below the coupling cover portion 105.

Figure 11:
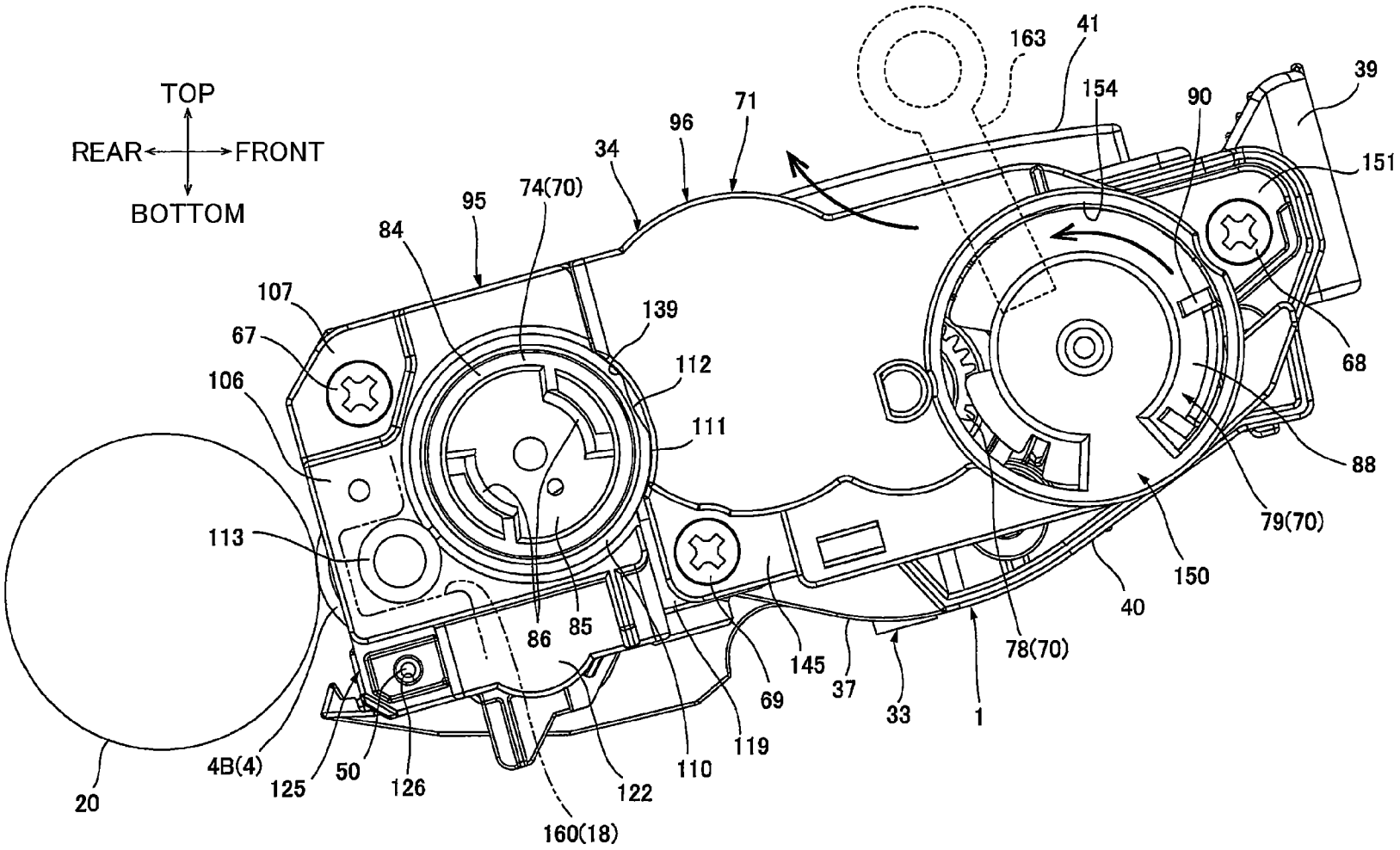
FIG. 11 is a left side view of the developing cartridge in FIG. 1 that has been attached to a main casing of the printer.

The engaging portion 125 is provided at a rear end portion of the second base plate 117. The engaging portion 125 is disposed below the developing roller cover portion 106 and rearward of the supply roller cover portion 122. The engaging portion 125 has a substantially bottomed frame-like shape with a closed right end. As illustrated in FIG. 11, the engaging portion 125 has an engaging insertion hole 126.

The engaging insertion hole 126 has a substantially circular in a side cross-sectional view. The engaging insertion hole 126 penetrates a right end portion of the engaging portion 125 in the left-right direction.

Further, as illustrated in FIG. 5, the engaging portion 125 includes a protruding wall 127.

The protruding wall 127 protrudes rightward from a lower-right end portion and a rear-right end portion of the engaging portion 125. The protruding wall 127 has a plate shape that is substantially L-like shaped in a side view.

As illustrated in FIGS. 5 and 6, the cutout portion 121 is formed by cutting a substantial front-rear center portion of a lower portion of the second peripheral wall 118 at a position rightward of the supply roller cover portion 122. In other words, the cutout portion 121 is defined as a space rightward of the supply roller cover portion 122 and frontward of the engaging portion 125.

The first co-fastening portion 119 is disposed frontward of the supply roller cover portion 122 and protrudes frontward from a front-right end portion of the second peripheral wall 118. The first co-fastening portion 119 is recessed rightward from the coupling cover portion 105. The first co-fastening portion 119 has a substantially box-like shape whose right end is opened and whose left end is closed. The first co-fastening portion 119 has a first co-fastening insertion hole 128.

The first co-fastening insertion hole 128 has a substantially circular shape in a side view. The first co-fastening insertion hole 128 penetrates, in the left-right direction, an up-down and front-rear center of the left end of the first co-fastening portion 119. The first co-fastening insertion hole 128 has an inner diameter larger than an outer diameter of the co-fastening engagement portion 48B of the co-fastening screwed portion 48.

(2-2-2) Second Cover

The second cover 96 is provided as a separate member from the first cover 95, and thus separable from the first cover 95. The second cover 96 integrally includes a third portion 131, a fourth portion 132, and a fifth portion 133.

The third portion 131 constitutes an upper-rear portion of the second cover 96. The third portion 131 integrally includes a third base plate 136, and a third peripheral wall 137 protruding rightward from a peripheral edge of the third base plate 136. That is, the third portion 131 has a substantially box-like shape whose right end is opened and whose left end is closed.

Figure 9:
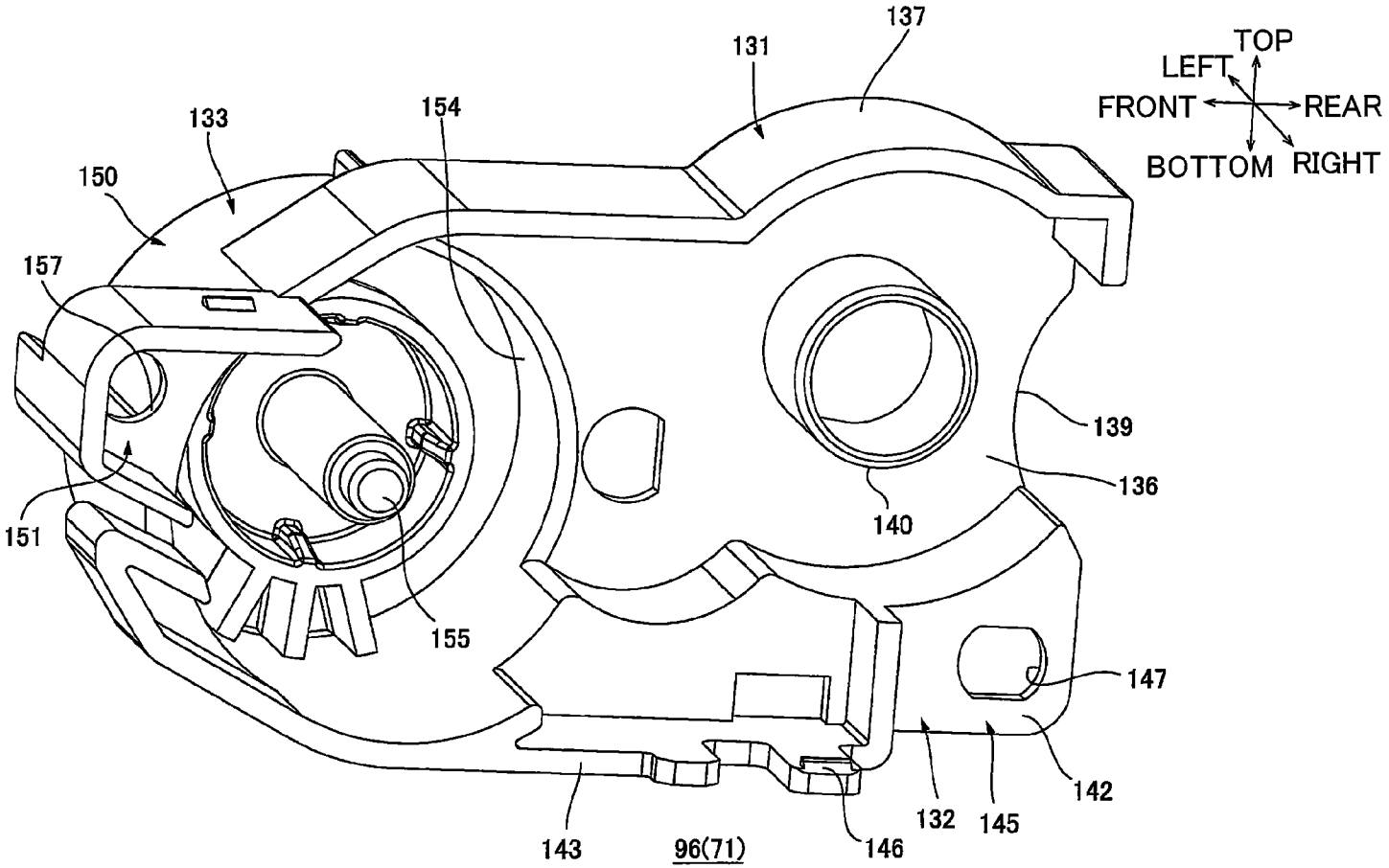
FIG. 9 is a perspective view of the second cover in FIG. 5 as viewed from an upper front side thereof.

As illustrated in FIGS. 9 and 12B, the third portion 131 includes an idle gear regulation portion 140 as an example of a support portion.

The idle gear regulation portion 140 has a substantially cylindrical shape protruding rightward from a right surface of the third base plate 136 at its substantial center. The idle gear regulation portion 140 has an outer diameter slightly smaller than the inner diameters of the large-diameter idle gear 77A and the intermediate-diameter idle gear 77B of the idle gear 77, respectively.

A rear edge of the third base plate 136 of the third portion 131 is recessed frontward in a curved manner and is defined as a second guide surface 139.

As illustrated in FIGS. 5 and 6, the fourth portion 132 constitutes a lower-rear portion of the second cover 96. The fourth portion 132 continues from a lower-right edge of the third peripheral wall 137 of the third portion 131 and protrudes downward therefrom. The fourth portion 132 includes a fourth base plate 142, and a fourth peripheral wall 143 protruding rightward from a lower edge of the fourth base plate 142. That is, the fourth portion 132 has a plate-like shape that is substantially L-like shaped in a front cross-sectional view.

The fourth portion 132 includes a second co-fastening portion 145 and an engaging claw 146.

The second co-fastening portion 145 is provided at a rear portion of the fourth base plate 142. The second co-fastening portion 145 has a second co-fastening insertion hole 147.

The second co-fastening insertion hole 147 has a substantially circular shape in a side view. The second co-fastening insertion hole 147 penetrates the fourth base plate 142 in the left-right direction.

As illustrated in FIG. 9, the engaging claw 146 protrudes rightward from a right end portion of the fourth peripheral wall 143 at its substantial front-rear center and is bent upward at a right end portion thereof. That is, the engaging claw 146 has a substantially hook-like shape.

As illustrated in FIGS. 5 and 6, the fifth portion 133 constitutes a front portion of the second cover 96. The fifth portion 133 continues from front edges of the respective third and fourth portions 131 and 132, and protrudes leftward therefrom. The fifth portion 133 includes a detection gear cover portion 150 and a second fixed portion 151.

The detection gear cover portion 150 continues from the front edges of the respective third and fourth portions 131 and 132, and protrudes leftward therefrom. The detection gear cover portion 150 has a substantially cylindrical shape with a closed left end. That is, the left end of the detection gear cover portion 150 is positioned leftward of the third and fourth portions 131 and 132. The detection gear cover portion 150 has an abutting portion opening 154 and includes a detection gear regulation portion 155 (see FIG. 9).

As illustrated in FIG. 3, the abutting portion opening 154 has a substantially C-like shape in a side view with a closed lower end so as to allow the abutting portion 90 of the detection gear 79 to protrude therethrough. The abutting portion opening 154 penetrates a left wall of the detection gear cover portion 150 in the left-right direction.

As illustrated in FIGS. 9 and 12B, the detection gear regulation portion 155 has a substantially columnar shape protruding rightward from a right surface of the left wall of the detection gear cover portion 150 at a center thereof. The detection gear regulation portion 155 has an outer diameter slightly smaller than an inner diameter of the detection gear insertion portion 92.

As illustrated in FIGS. 5 and 6, the second fixed portion 151 protrudes frontward from an upper-front end portion of the detection gear cover portion 150 at its right end. The second fixed portion 151 has a substantially box-like shape whose right end is opened and whose left end is closed. A left wall of the second fixed portion 151 is positioned rightward of the third base plate 136 and substantially flush with the fourth base plate 142. The second fixed portion 151 has a second insertion hole 157.

The second insertion hole 157 has a substantially circular shape in a side view. The second insertion hole 157 penetrates the left wall of the second fixed portion 151 in the left-right direction. The second insertion hole 157 has an inner surface slightly larger than an outer diameter of the second engagement portion 49B.

4. Assembly and Removal of Gear Cover Relative to Frame

The gear cover 71 having the above-described configuration is assembled to the frame 33 by a user.

In order to assemble the gear cover 71 to the frame 33, first, the first cover 95 of the gear cover 71 is assembled, from the left, to the left wall 37 to which the gear train 70 has been assembled, as illustrated in FIG. 5. More specifically, the first cover 95 is assembled, from the left, to the left wall 37 with the collar portion 113 receiving the developing roller shaft 4A and with the cylindrical portion 110 receiving the coupling portion 84.

Then, the first insertion hole 114 of the first cover 95 receives the first engagement portion 47B of the left wall 37, the first co-fastening insertion hole 128 of the first cover 95 receives the co-fastening engagement portion 48B of the left wall 37 and, as illustrated in FIG. 11, the engaging insertion hole 126 of the engaging portion 125 of the first cover 95 receives the protruding portion 50 of the left wall 37.

Figure 7:
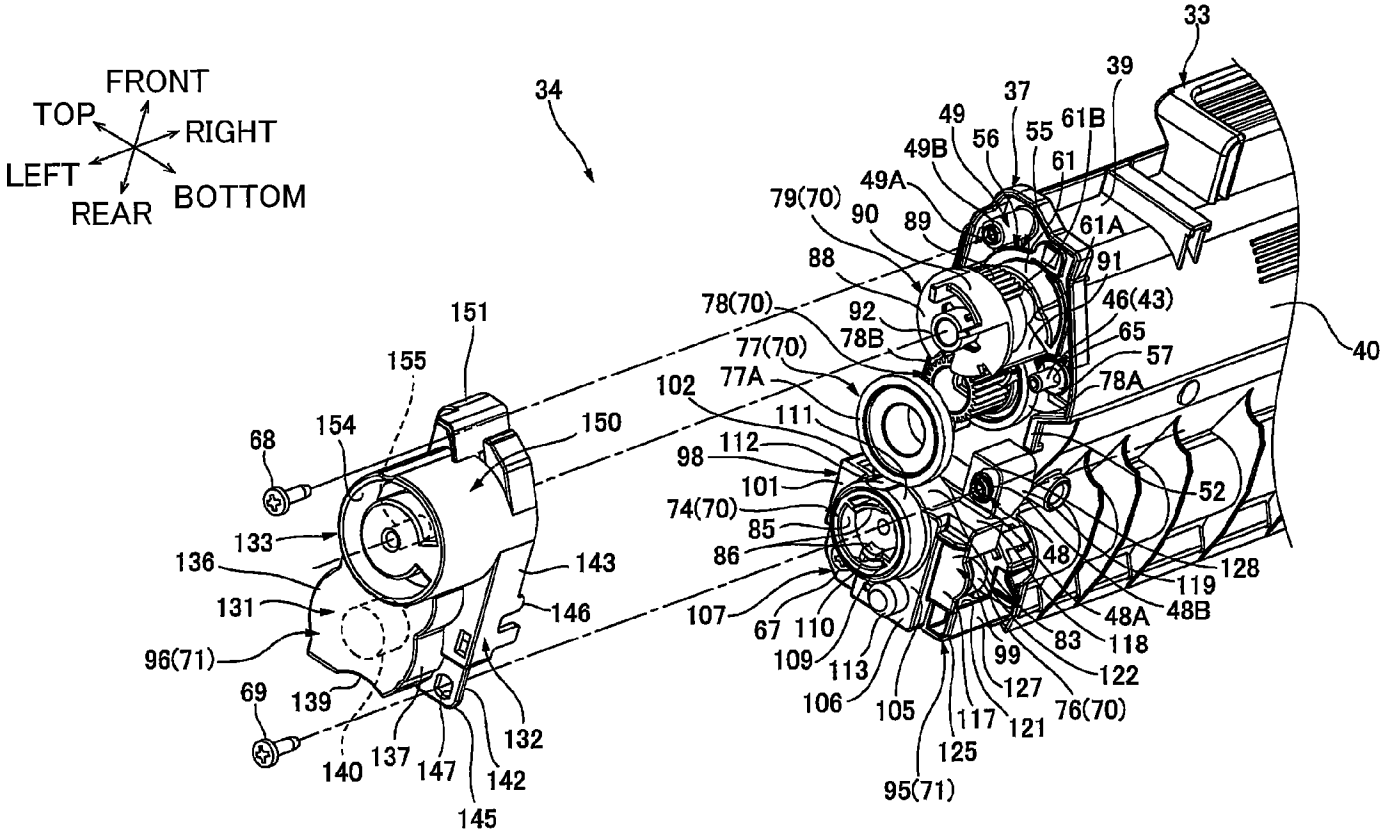
FIG. 7 is an exploded partial perspective view of the developing cartridge in FIG. 1 as viewed from a lower-left side thereof, to which a first cover of the gear cover has been assembled and from which a second cover of the gear cover has been removed.

As a result, as illustrated in FIG. 7, a left end face of the supply gear 76 and a right surface of the supply roller cover portion 122 face each other in the left-right direction with a space therebetween.

Next, a first screw 67 as an example of a screw member is screwed into the first screw hole 47A through the first insertion hole 114.

Thus, the first cover 95 is assembled to the left wall 37 so as to cover the developing coupling 74, the developing gear 75, and the supply gear 76.

Incidentally, a lower end portion of the supply gear 76 is exposed to outside through the cutout portion 121 of the supply roller cover portion 122. Further, as described above, the coupling cover portion 105 covers a part of the idle gear 77.

Subsequently, the second cover 96 is assembled, from the left, to the left wall 37.

Figure 10B:
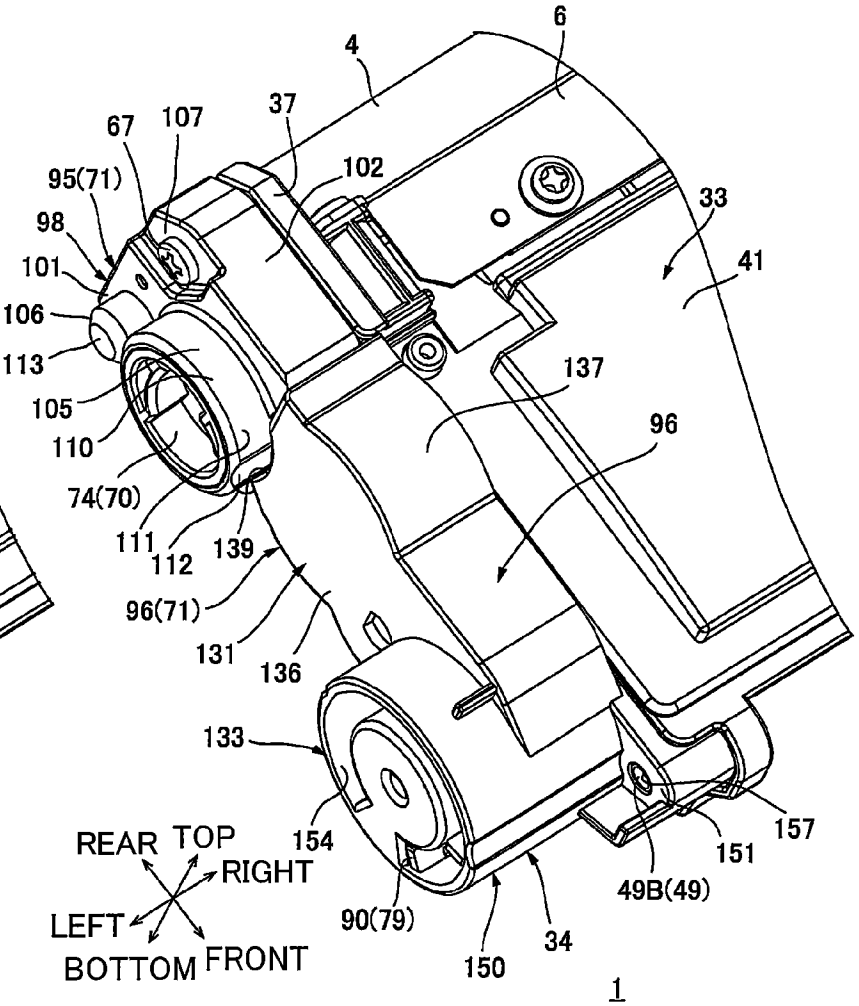
FIG. 10B is an explanatory view for illustrating the assembly of the gear cover to the left wall of the frame, following FIG. 10A, in which the first cover and the second cover have been assembled to the left wall of the frame.
Figure 10A:
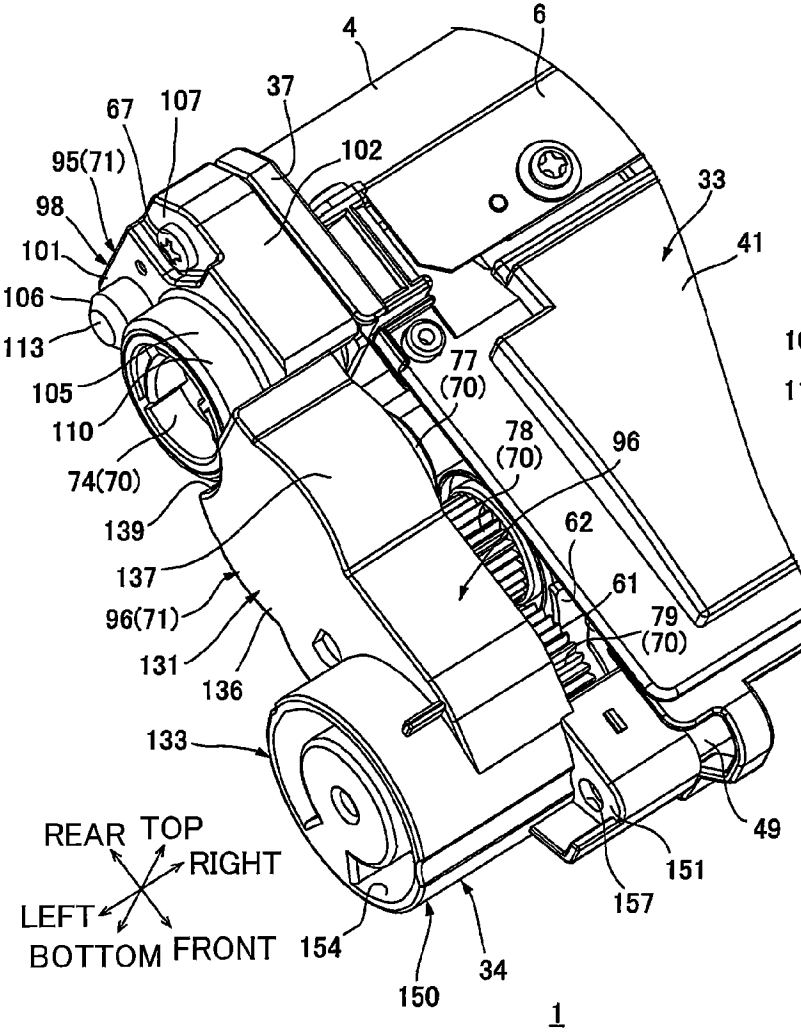
FIG. 10A is an explanatory view for illustrating an assembly of the gear cover to a left wall of a frame of the developing cartridge in FIG. 1, in which the first cover has been assembled to the left wall of the frame and the second cover is in the course of being assembled to the left wall of the frame.

As illustrated in FIGS. 10A and 10B, in this assembly of the second cover 96 to the left wall 37, the second guide surface 139 of the second cover 96 is guided by the first guide surface 111 of the first cover 95 while slidingly contacting the first guide surface 111. Then, the second insertion hole 157 of the second cover 96 receives the second engagement portion 49B of the left wall 37, and the second co-fastening insertion hole 147 of the second cover 96 receives the co-fastening engagement portion 48B of the left wall 37. Further, the engaging claw 146 is engaged with the hooking portion 52. In this state, as illustrated in FIG. 12B, the idle gear regulation portion 140 of the second cover 96 is inserted into the large-diameter idle gear 77A of the idle gear 77, and the detection gear regulation portion 155 of the second cover 96 is inserted into the detection gear insertion portion 92 of the detection gear 79.

As a result, the third base plate 136 covers the idle gear 77 and the agitator gear 78, and the detection gear cover portion 150 covers the detection gear 79. Further, the idle gear 77 and the detection gear 79 are each rotatably supported to the left wall 37 without displacement of the rotation axis (center axis) thereof.

Then, as illustrated in FIGS. 5 and 6, a second screw 68 as an example of a screw member is screwed into the second screw hole 49A through the second insertion hole 157.

Further, as illustrated in FIG. 7, a co-fastening screw 69 as an example of a screw member is screwed into the co-fastening screw hole 48A through the first co-fastening insertion hole 128 and the second co-fastening insertion hole 147. That is, the first cover 95 and the second cover 96 are co-fastened by the common screw member. The second co-fastening portion 145 of the second cover 96 is disposed leftward of the first co-fastening portion 119 of the first cover 95.

Thus, the second cover 96 is assembled to the left wall 37 so as to cover the idle gear 77, the agitator gear 78, the detection gear 79, and the cap 55.

In this manner, assembly of the developing cartridge 1 is completed.

To remove the gear cover 71 from the left wall 37, the operation to assemble the gear cover 71 to the left wall 37 described above is performed in reverse.

More specifically, the second screw 68 is unscrewed from the second screw hole 49A, and the co-fastening screw 69 is unscrewed from the co-fastening screw hole 48A. This allows the second cover 96 to be separated from the first cover 95, and only the second cover 96 is removed from the left wall 37.

Then, the detection gear 79 is removed from the gear train 70, and this allows the cap 55 to be removed from the toner filling port 44. When the cap 55 is removed from the toner filing port 44, the toner filling port 44 is exposed to an outside. Thus, toner can be supplied to the toner chamber 7 through the toner filing port 44.

Figure 13A:
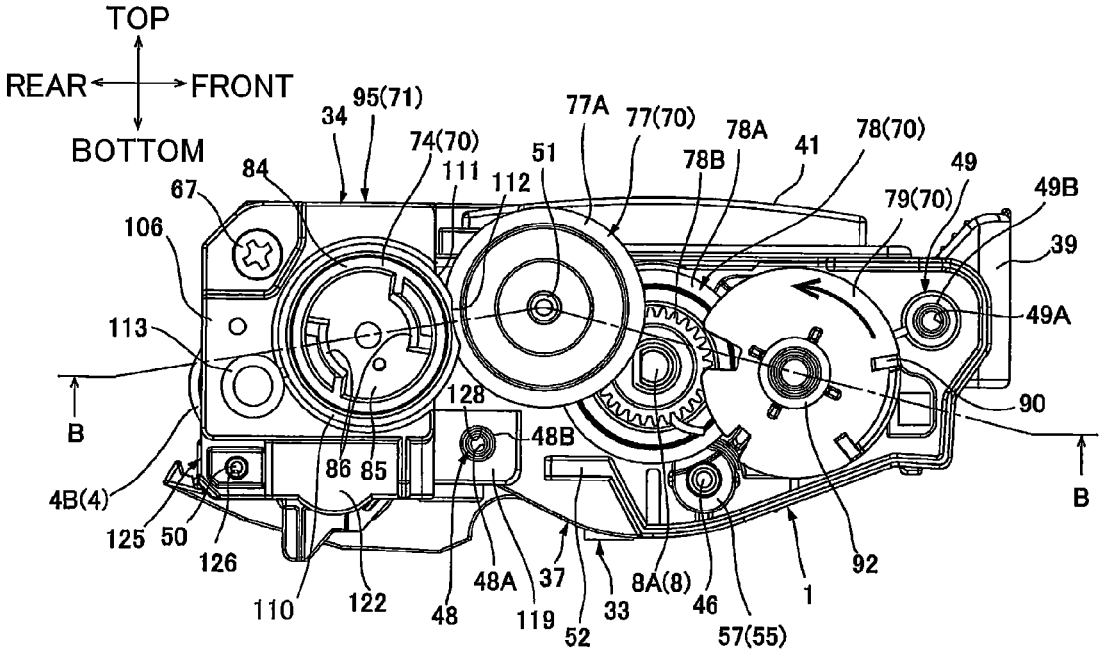
FIG. 13A is a left side view of the developing cartridge in FIG. 1 in which the first cover has been assembled to the left wall but the second cover has been removed from the left wall.

Further, as illustrated in FIG. 13A, the front end portion of the cylindrical portion 110 is overlapped with a rear end portion of the idle gear 77 in a left side view. In other words, the first cover 95 covers a part of the idle gear 77. This prevents the idle gear 77 from coming off from the left wall 37.

Figure 13B:
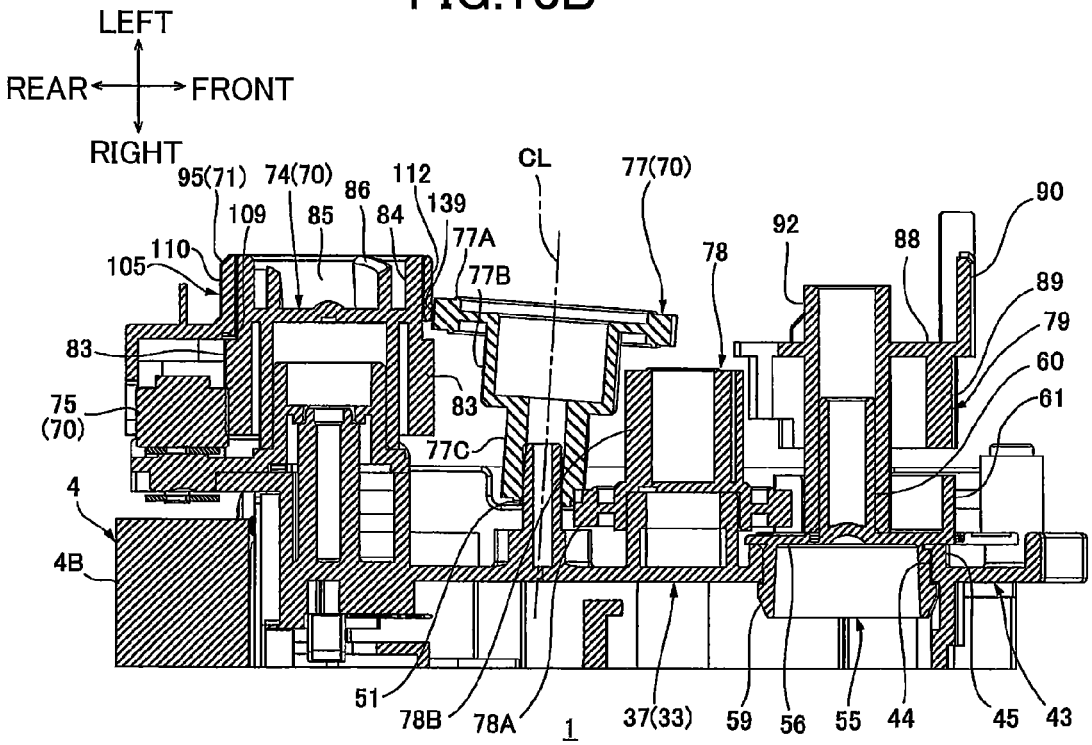
FIG. 13B is a cross-sectional view of the developing cartridge taken along a line B-B in FIG. 13A.

To remove the idle gear 77 from the left wall 37, the idle gear 77 is inclined frontward relative to the idle gear support shaft 51, as illustrated in FIG. 13B. Then, the overlap between the idle gear 77 and the first cover 95 is released as viewed in the left-right direction. That is, as viewed in the left-right direction, the idle gear 77 and the first cover 95 are no longer overlapped with each other, thus releasing the covering of the idle gear 77 by the first cover 95 is released.

This allows only the idle gear 77 to be removed from the left wall 37.

Further, the removal of the idle gear 77 from the left wall 37 allows removal of the agitator gear 78 disposed inward in the left-right direction (i.e. rightward) of the idle gear 77.

As a result, the idle gear 77 and the agitator gear 78 can be removed from the left wall 37 with the first cover 95 still assembled to the left wall 37 and can then be subjected to maintenance.

Subsequently, the first screw 67 is unscrewed from the first screw hole 47A, and the first cover 95 is removed from the left wall 37. Thus, the gear cover 71 is removed from the left wall 37.

5. Attachment of Developing Cartridge to Main Casing and New Cartridge Detection Operation In order to attach the developing cartridge 1 to the main casing 12, the developing cartridge 1 is first attached to the drum cartridge 18 to constitute the process cartridge 13.

As illustrated in FIG. 11, the drum cartridge 18 has left and right side walls at which collar receiving grooves 160 are formed respectively. The collar receiving groove 160 at the left side wall of the drum cartridge 18 receives the collar portion 113 of the gear cover 71 and fixes the collar portion 113 in position when the developing cartridge 1 is attached to the drum cartridge 18.

The collar portion 113 rotatably receives the left end portion of the developing roller shaft 4A. Thus, by attaching the developing cartridge 1 to the drum cartridge 18 with the collar portion 113 as a reference, the developing roller 4 is precisely fixed in position relative to the photosensitive drum 20.

Subsequently, the drum cartridge 18 to which the developing cartridge 1 has been attached, that is, the process cartridge 13 is attached to the main casing 12.

To attach the process cartridge 13 to the main casing 12, as illustrated in FIG. 2, the front cover 17 is opened, and the process cartridge 13 is inserted, from the front, into the main casing 12 through the opening portion 16 and attached to the main casing 12.

In this manner, the attachment of the process cartridge 13 to the main casing 12 is completed.

As illustrated in FIG. 11, when the developing cartridge 1 is a new cartridge, the abutting portion 90 of the detection gear 79 is positioned in the abutting portion opening 154 of the second cover 96 at a front end portion thereof. As illustrated in FIG. 3, a left edge of the abutting portion 90 is substantially flush with a left end face of the detection gear cover portion 150. Further, as illustrated in FIG. 8, the detection gear portion 89 of the detection gear 79 is meshingly engaged with a front end portion of the small-diameter agitator gear 78B of the agitator gear 78 at a downstream end portion thereof in the counterclockwise direction in a left side view. Further, the slide portion 91 of the detection gear 79 is positioned upstream of the guide portion 61 of the cap 55 in the counterclockwise direction in a left side view. That is, the guide portion 61 of the cap 55 is positioned upstream of the upstream inclined portion 61A in the counterclockwise direction in a left side view.

When the printer 11 starts its warm-up operation, a drive input unit (not illustrated) of the main casing 12 inputs a drive force to the developing coupling 74.

Upon receiving the drive force, the developing coupling 74 transmits the drive force to the idle gear 77 and the agitator gear 78 through the coupling gear portion 83. Upon receiving the drive force, the idle gear 77 and the agitator gear 78 transmit the drive force to the detection gear portion 89 of the detection gear 79. Then, the detection gear 79 rotates in the counterclockwise direction in a left side view, as illustrated in FIG. 11.

At this time, the slide portion 91 of the detection gear 79 is slidingly moved along the left end surface of the guide portion 61 in the counterclockwise direction in a left side view. Accordingly, the slide portion 91 is gradually moved leftward along the upstream inclined portion 61A of the guide portion 61, and the abutting portion 90 of the detection gear 79 protrudes leftward further than the left end face of the detection gear cover portion 150 through the abutting portion opening 154.

Then, in a state where the abutting portion 90 protrudes leftward further than the abutting portion opening 154, the detection gear 79 rotates in the counterclockwise direction in a left side view while the slide portion 91 is moved along the intermediate flat portion 61B. Then, the abutting portion 90 abuts against an actuator 163 of the main casing 12. As a result, the actuator 163 detects a condition of the developing cartridge 1.

The slide portion 91 urges, with an urging force from an urging spring (not illustrated), the detection gear 79 rightward along a downstream end of the guide portion 61 in the counterclockwise direction in a left side view, that is, along the downstream inclined portion 61C.

Then, the slide portion 91 abuts against one of the pair of stoppers 62 (i.e. upper stopper 62) from a front side thereof to stop the rotation of the detection gear 79. Further, the meshing engagement of the detection gear portion 89 of the detection gear 79 with the small-diameter agitator gear 78B of the agitator gear 78 is released.

As a result, the left edge of the abutting portion 90 becomes substantially flush with the left end face of the detection gear cover portion 150 once again.

When the developing cartridge 1 is a used cartridge, the abutting portion 90 of the detection gear 79 is positioned in the abutting portion opening 154 of the second cover 96 at a rear end portion thereof and the left edge of the abutting portion 90 is substantially flush with the left end face of the detection gear cover portion 150. Further, the detection gear portion 89 of the detection gear 79 is not engaged with the small-diameter agitator gear 78B of the agitator gear 78. Further, the slide portion 91 of the detection gear 79 is positioned downstream of the guide portion 61 of the cap 55 in the counterclockwise direction in a left side view. Thus, when the printer 11 starts its warm-up operation, the detection gear 79 does not start rotating and maintains its posture.

As described above, the posture of the detection gear 79 can be changed depending on whether the developing cartridge 1 is a new cartridge or not.

6. Operations and Effects (1) According to the developing cartridge 1 described above, as illustrated in FIGS. 4 and 5, the first cover 95 covers the coupling gear portion 83 of the developing coupling 74, the second cover 96 covers the cap 55, and the first and second covers 95 and 96 are configured to be separable from each other.

Thus, the second cover 96 can be separated from the first cover 95 and then removed from the left wall 37 in a state where the first cover 95 has been assembled to the left wall 37. Accordingly, the toner filling port 44 can be exposed to an outside for toner supply with the coupling gear portion 83 of the developing coupling 74 being covered with the first cover 95.

As a result, removal of only the second cover 96 from the left wall 37 allows supply of the toner. At the same time, the first cover 95 prevents damage to the coupling gear 83 of the developing coupling 74 to which the drive force is inputted.

This allows the toner to be supplied through the toner filling port 44 while protecting the coupling gear portion 83 of the developing coupling 74, thereby increasing reliability of the developing cartridge 1.

(2) Further, according to the developing cartridge 1, as illustrated in FIG. 6, the first cover 95 covers the coupling gear portion 83, and the coupling portion 84 integrally formed with the coupling gear portion 83. The coupling portion 84 is positioned on the most upstream side among the gears of the gear train 70 for transmission of the drive force, and is the most important functional component for image formation among the gears of the gear train 70. Thus, it is important to prevent the coupling portion 84 from being damaged.

Thus, the coupling portion 84 is covered and protected by the first cover 95. This allows the drive force from the drive input unit (not illustrated) of the main casing 12 to be inputted reliably to the coupling portion 84, thereby allowing the drive force inputted to the coupling portion 84 to be transmitted reliably to the agitator 8 by the coupling gear portion 83.

(3) Further, according to the developing cartridge 1, as illustrated in FIG. 6, the second cover 96 covers the agitator gear 78.

Thus, the second cover 96 can be separated from the first cover 95 and then removed from the left wall 37 to allow a covered state of the agitator gear 78 to be released.

This facilitates maintenance of the agitator gear 78 with the coupling gear portion 83 of the developing coupling 74 being covered by the first cover 95.

(4) Further, according to the developing cartridge 1, as illustrated in FIGS. 13A and 13B, even when the second cover 96 is removed from the left wall 37 for supply of the toner through the toner filling port 44, the covered state of the idle gear 77 by the first cover 95 is not released unless the idle gear 77 is inclined in a direction intersecting a direction in which the rotation axis CL extends, that is, frontward.

Thus, the toner can be supplied while preventing the idle gear 77 from coming off from the left wall 37.

(5) Further, according to the developing cartridge 1, as illustrated in FIGS. 12A and 12B, the frontward inclination of the idle gear 77 is regulated by the idle gear regulation portion 140, thereby preventing the idle gear 77 from coming off from the left wall 37.

This allows the drive force inputted from the drive force input unit (not illustrated) of the main casing 12 to the coupling gear portion 83 to be transmitted reliably to the agitator gear 78 through the idle gear 77.

(6) Further, according to the developing cartridge 1, as illustrated in FIGS. 13A and 13B, the first cover 95 covers a part of the idle gear 77 by contacting the idle gear 77 from the left.

Thus, even in a state where the second cover 96 is removed from the left wall 37 and only the first cover 95 is assembled to the left wall 37, the idle gear 77 can be prevented from coming off from the left wall 37.

(7) Further, according to the developing cartridge 1, as illustrated in FIGS. 12A and 12B, the idle gear 77 is sandwiched between the agitator gear 78 and the first cover 95 so as to contact the agitator gear 78 and the first cover 95.

Thus, even in a state where the second cover 96 is removed, the idle gear 77 is prevented from coming off from the left wall 37 by the first cover 95, and the agitator gear 78 is prevented from coming off from the left wall 37 by the idle gear 77.

(8) Further, according to the developing cartridge 1, as illustrated in FIG. 5, the developing gear 75 is covered with the first cover 95.

Thus, even in a state where the second cover 96 is separated from the first cover 95 and then removed from the left wall 37 for supply of the toner, the developing gear 75 can be covered by the first cover 95.

(9) Further, according to the developing cartridge 1, the first cover 95 is fixed in position relative to the left wall 37 with the developing roller shaft 4A as a reference shaft. Further, as illustrated in FIG. 11, the collar receiving groove 160 formed in the drum cartridge 18 guides the collar portion 113 of the first cover 95 when attaching the developing cartridge 1 to the drum cartridge 18. Hence, the developing cartridge 1 can be fixed in position relative to the drum cartridge 18 with the developing roller shaft 4A as a reference shaft.

This can bring the developing roller 4 into contact with the photosensitive drum 20 precisely.

(10) Further, according to the developing cartridge 1, as illustrated in FIG. 4, the detection gear 79 is positioned so as to overlap with the cap 55 as viewed in the left-right direction. Thus, the members constituting the developing cartridge 1 can be gathered into one place.

This allows reduction in size of the developing cartridge 1.

(11) Further, according to the developing cartridge 1, as illustrated in FIG. 11, the detection gear 79 configured to change its posture depending on whether the developing cartridge 1 is a new cartridge or a used cartridge is positioned so as to overlap with the cap 55 as viewed in the left-right direction. Thus, the members constituting the developing cartridge 1 can be gathered into one place.

This allows determination of whether the developing cartridge 1 is a new cartridge or a used cartridge while achieving reduction in size of the developing cartridge 1.

(12) Further, according to the developing cartridge 1, as illustrated in FIG. 5, the first cover 95 and the second cover 96 can be fixed together to the left wall 37 by screwing the common co-fastening screw 69 into the co-fastening screwed portion 48 of the left wall 37, thereby improving assembly precision and reducing the number of components.

(13) Further, according to the developing cartridge 1, as illustrated in FIG. 5, even when the first cover 95 and the second cover 96 are fixed together in an overlapped manner to the left wall 37 by means of the common co-fastening screw 69, the second cover 96 can be removed from the left wall 37 by unscrewing the co-fastening screw 69 with the first cover 95 being assembled to the left wall 37.

Thus, with the first cover 95 being assembled to the left wall 37, the second cover 96 can be removed from the left wall 37 for supply of the toner through the toner filling port 44.

As a result, the toner can be supplied while reliably covering the coupling gear portion 83 of the developing coupling 74 with the first cover 95.

(14) Further, according to the developing cartridge 1, as illustrated in FIGS. 10A and 10B, the second cover 96 can be assembled to the left wall 37 with the second guide surface 139 of the second cover 96 fixed in position relative to the first guide surface 111 of the cylindrical portion 110 and guided by the first guide surface 111 of the cylindrical portion 110.

Thus, the second cover 96 can be assembled to the left wall 37 while being fixed in position precisely relative to the first cover 95.

(15) Further, according to the developing cartridge 1, as illustrated in FIG. 5, the supply gear 76 is covered with the first cover 95.

Thus, even when the second cover 96 is separated from the first cover 95 and then removed from the left wall 37 for supply of the toner, the supply gear 76 can be covered with the first cover 95.

In addition, as illustrated in FIG. 3, the first cover 95 has the cutout portion 121 so that the lower end portion of the supply gear 76 is exposed to an outside.

This allows reduction in size of the first cover 95, which in turn can achieve further reduction in size of the developing cartridge 1.

7. Modifications

Various modifications are conceivable. In the following description, only parts differing from those of the embodiment will be described in detail.

Figures 14A, 14B:
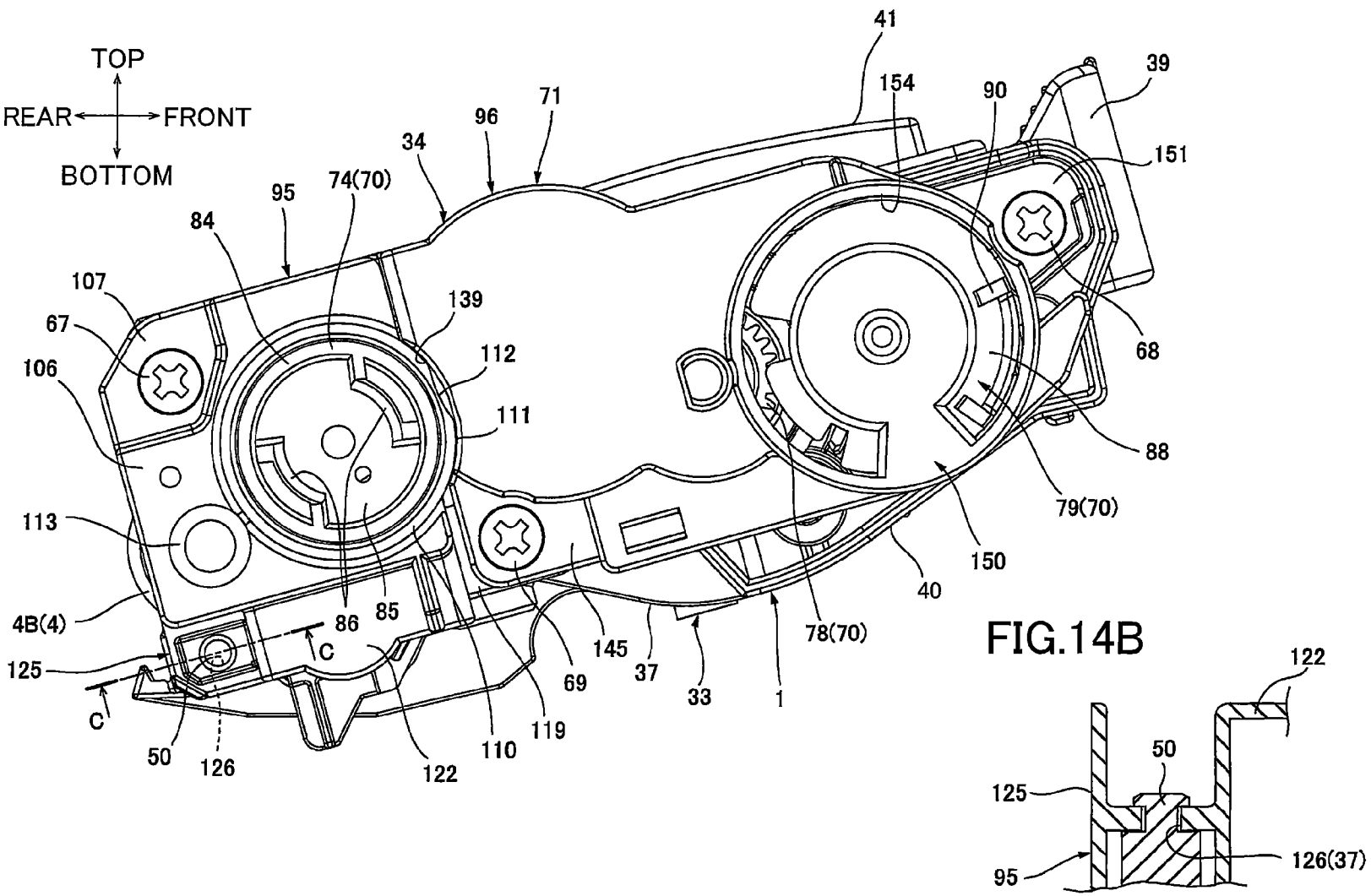
FIG. 14A is a left side view of a developing cartridge according to a modification to the embodiment.
FIG. 14B is a cross-sectional view of the developing cartridge taken along a line C-C in FIG. 14A.

For example, as illustrated in FIG. 14, the protruding portion 50 of the left wall 37 that has been inserted through the engaging insertion hole 126 formed in the engaging portion 125 of the first cover 95 may be force-fitted (such as caulking accompanied by plastic deformation) at its left end portion.

According to such a modification to the developing cartridge 1, the force-fitting of the protruding portion 50 of the left wall 37 relative to the first cover 95 can prevent the first cover 95 from unintentionally coming off from the frame 33 at the time of removal of the second cover 96.

As a result, the first cover 95 and the second cover 96 can be efficiently assembled to and removed from the left wall 37.

In place of the force-fitting, the protruding portion 50 may be adhered to the engaging portion 125 by an adhesive agent, etc., to assemble the first cover 95 to the frame 33.

Although the process cartridge 13 according to the above embodiment is a separate type in which the developing cartridge 1 and the drum cartridge 18 are separable from each other, the process cartridge 13 may be configured as an integrated type that integrally includes the developing cartridge 1 and the drum cartridge 18.

Further, the cartridge according to the present invention may be configured as a toner cartridge in which the developing roller 4 is not provided but the agitator 8 is provided.

In place of the cap 55 as an example of a closing member, a sealing member or a shutter may be available.

In place of the detection gear 79, a rotation body such as a drive transmission roller around which a belt is stretched and that is rotated by friction may be available.

While the present invention has been described in detail with reference to the embodiment thereof, it would be apparent to those skilled in the art that various changes and modifications may be made therein without departing from the spirit of the present invention.

What is claimed is:

1. A cartridge comprising:

a frame having a first wall and a second wall spaced apart from the first wall, the first wall having a developer filling port;

an agitator supported to the first wall and the second wall, the agitator having an agitator shaft;

a coupling provided at the first wall and configured to receive a drive force from an external drive source;

a first transmission gear provided at the first wall and configured to transmit the drive force received by the coupling to the agitator;

a closing member provided at the first wall and configured to close the developer filling port;

a cover member provided at the first wall, the cover member comprising:

a first cover configured to cover the first transmission gear; and a second cover provided separately from the first cover, the second cover being configured to cover the closing member; and an agitator drive gear fixed to the agitator shaft and configured to transmit the drive force from the first transmission gear to the agitator, the second cover being configured to cover the agitator drive gear.

2. The cartridge as claimed in claim 1, wherein the first transmission gear is integral with the coupling.

3. The cartridge as claimed in claim 1, further comprising a second transmission gear provided at the first wall and having a rotation axis extending in an axial direction, the second transmission gear being configured to transmit the drive force from the first transmission gear to the agitator drive gear, the second transmission gear having a first portion covered with the first cover and a second portion covered with the second cover, wherein the second transmission gear is configured to be inclined in a direction angled with respect to the axial direction to expose the first portion of the second transmission gear to an outside of the first cover.

4. The cartridge as claimed in claim 3, wherein the second cover includes a support portion configured to regulate the second transmission gear from being inclined in the direction angled with respect to the axial direction.

5. The cartridge as claimed in claim 3, wherein the first cover is disposed opposite to the second wall with respect to the first wall in the axial direction; and wherein the second transmission gear is disposed between the first cover and the first wall in the axial direction at a position adjacent to the first cover and contactable with the first cover.

6. The cartridge as claimed in claim 4, wherein the first cover is disposed opposite to the second wall with respect to the first wall in the axial direction;

wherein the second transmission gear is configured to be meshingly engaged with the agitator drive gear; and wherein the second transmission gear is disposed between the first cover and the agitator drive gear in the axial direction at a position adjacent to the agitator drive gear and contactable with the agitator drive gear.

7. The cartridge as claimed in claim 1, further comprising:

a developing roller supported to the first wall and the second wall, the developing roller having a developing roller shaft; and a developing roller drive gear fixed to the developing roller shaft and configured to transmit the drive force received by the coupling to the developing roller, the first cover being configured to cover the developing roller drive gear.

8. The cartridge as claimed in claim 7, wherein the first cover is fixed in position relative to the first wall by the developing roller shaft serving as a reference shaft.

9. The cartridge as claimed in claim 1, wherein the agitator shaft extends in a predetermined direction, the cartridge further comprising:

a gear aligned with the closing member in the predetermined direction.

10. The cartridge as claimed in claim 1, wherein the agitator shaft extends in a predetermined direction, the cartridge further comprising:

a rotation body aligned with the closing member in the predetermined direction, the rotation body being configured to have a first posture indicative of a new cartridge and a second posture indicative of a used cartridge, the second posture being different from the first posture.

11. The cartridge as claimed in claim 1, wherein the first cover is assembled to the first wall by force-fitting to regulate detachment of the first cover from the frame; and wherein the second cover is assembled to the first wall by a screw member.

12. The cartridge as claimed in claim 1, wherein the first cover and the second cover are assembled to the first wall by a common screw member.

13. The cartridge as claimed in claim 12, wherein the agitator shaft extends in a predetermined direction; and wherein, as viewed in the predetermined direction, the second cover is disposed opposite to the first wall with respect to the first wall at a position where the first cover, the second cover and the common screw member overlap one another.

14. The cartridge as claimed in claim 1, wherein the agitator shaft extends in a predetermined direction;

wherein the first cover includes a receiving portion formed in an annular shape extending in the predetermined direction, the receiving portion being configured to receive the coupling; and wherein the receiving portion is configured to guide the second cover so that the second cover moves in the predetermined direction to be assembled to the first wall.

15. The cartridge as claimed in claim 1, further comprising:

a supply roller supported to the first wall and the second wall, the supply roller having a supply roller shaft; and a supply roller drive gear fixed to the supply roller shaft and configured to transmit the drive force received by the coupling to the supply roller, wherein the first cover is configured to cover the supply roller drive gear; and wherein the agitator shaft extends in a predetermined direction, the supply roller drive gear having a portion exposed to an outside through the first cover as viewed in a direction perpendicular to the predetermined direction.

16. A cartridge comprising:

a frame configured to accommodate developing agent therein, the frame having a developer filling port;

an agitator configured to agitate the developing agent, the agitator having an agitator shaft;

a coupling configured to receive a drive force from an external drive source;

a first transmission gear configured to transmit the drive force received by the coupling to the agitator;

a closing member configured to close the developer filling port;

a cover member comprising:

a first cover configured to cover the first transmission gear; and a second cover provided separately from the first cover, the second cover being configured to cover the closing member; and an agitator drive gear fixed to the agitator shaft and configured to transmit the drive force from the first transmission gear to the agitator, the second cover being configured to cover the agitator drive gear.

17. The cartridge as claimed in claim 16, wherein the first transmission gear is integral with the coupling.

18. The cartridge as claimed in claim 16, wherein the first cover and the second cover are assembled to the frame by a common screw member.

* * * * *